US006267519B1

(12) United States Patent
Otsuki et al.

(10) Patent No.: US 6,267,519 B1
(45) Date of Patent: Jul. 31, 2001

(54) POSITIONAL DEVIATION CORRECTION USING DIFFERENT CORRECTION VALUES FOR MONOCHROME AND COLOR BI-DIRECTIONAL PRINTING

(75) Inventors: Koichi Otsuki; Shuji Yonekubo; Kazushige Tayuki; Toyohiko Mitsuzawa, all of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/497,177

(22) Filed: Feb. 3, 2000

(30) Foreign Application Priority Data

Feb. 10, 1999 (JP) ..... 11-032163
Aug. 18, 1999 (JP) ..... 11-231265

(51) Int. Cl.[7] ..... B41J 21/16; B41J 19/00; B41J 3/42

(52) U.S. Cl. ..... 400/283; 400/279; 400/74

(58) Field of Search ..... 400/283, 279, 400/74

(56) References Cited

U.S. PATENT DOCUMENTS 5,276,459 * 1/1994 Danzuka et al. ..... 346/33
6,039,427 * 3/2000 Kanome ..... 347/19
6,084,606 * 7/2000 Moriyama ..... 347/19

FOREIGN PATENT DOCUMENTS 0 622 239 11/1994 (EP) .
0 858 049 8/1998 (EP) .
0 895 869 2/1999 (EP) .
5-69625 3/1993 (JP) .
411005343A * 1/1999 (JP) .

OTHER PUBLICATIONS

U.S. application No. 09/497,177, filed Feb. 3, 2000, pending.

U.S. application No. 09/642,909, filed Aug. 22, 2000, pending, Docket No. 196195US2.

* cited by examiner

*Primary Examiner*—John S. Hilten
*Assistant Examiner*—Charles H. Nolan, Jr.
(74) *Attorney, Agent, or Firm*—Oblon, Spivak, McClelland. Maier & Neustadt, P.C.

(57) ABSTRACT

In monochrome printing mode, a first correction value is set for correcting printing positional deviation between ink droplets printed during forward and reverse main scanning passes. In color printing mode, a second correction value is set for correcting printing positional deviation between ink droplets printed during forward and reverse main scanning passes. An adjustment value is determined for reducing printing positional deviation during forward and reverse main scanning passes. For this, in monochrome printing mode the first correction value is used as an adjustment value, and in color printing mode at least a second correction value is used to determine an adjustment value. Following this, the adjustment value is used to adjust printing positions during forward and reverse main scanning passes.

20 Claims, 26 Drawing Sheets

POSITIONAL DEVIATION DURING BI-DIRECTIONAL PRINTING FOR DOTS OF DIFFERENT INKS

TEST PATTERN FOR DETERMINING RELATIVE CORRECTION VALUE

| HEAD ID | Δ (μm) |
|---|---|
| 1 | −35.0 |
| 2 | −17.5 |
| 3 | 0 |
| 4 | +17.5 |

BEFORE ADJUSTMENT

ADJUSTED BASED ON REFERENCE CORRECTION VALUE (K ONLY)

ADJUSTED BASED ON REFERENCE CORRECTION VALUE (K + C)

ADJUSTED BASED ON REFERENCE + RELATIVE CORRECTION VALUES (K + C)

K DOTS AND C DOTS ARE THE TARGET OF ADJUSTMENT (RELATIVE CORRECTION VALUE $\Delta = -\delta c$)

TEST PATTERN FOR DETERMINING CORRECTION VALUE

TEST PATTERN FOR DETERMINING CORRECTION VALUE

POSITIONAL DEVIATION CORRECTION USING DIFFERENT CORRECTION VALUES FOR MONOCHROME AND COLOR BI-DIRECTIONAL PRINTING

BACKGROUND OF THE INVENTION

1. Field of the Invention

This invention relates to a technology for printing images on a print medium using a bi-directional reciprocating movement in a main scanning direction. The invention particularly relates to a technology for correcting printing positional deviation between forward and reverse passes.

2. Description of the Related Art

In recent years color printers that emit colored inks from a print head are coming into widespread use as computer output devices. In recent years, such color printers have been devised as multilevel printers able to print each pixel using a plurality of dots having different sizes. Such printers use relatively small ink droplets to form relatively small dots on a pixel position, and relatively large ink droplets to form relatively large dots on a pixel position. These printers can also print bi-directionally to increase the printing speed.

A problem that readily arises in bi-directional printing is that of deviation in printing position between forward and reverse printing passes in the main scanning direction caused by backlash in the main scanning drive mechanism and warping of the platen that supports the print media. JP-A-5-69625 is an example of a technology disclosed by the present applicants for solving this problem of positional deviation. This comprises of registering beforehand the printing deviation amount in the main scanning direction and using this printing deviation amount as a basis for correcting the positions at which dots are printed during forward and reverse passes.

However, deviation may be corrected with respect to a particular one of the multiple colored inks, there is no correction of deviation in other ink colors. As a result, the deviation correction provides little improvement in the quality of the color image. The effect that positional deviation has on image quality is particularly large in halftone regions.

Also, during color printing, it is necessary to effect correction of printing positional deviation that takes account of each color ink. With respect to monochrome printing, however, it is only necessary to correct deviation with respect to the ink used for the monochrome printing. There are many differences between correcting with respect to the ink used for monochrome printing and correcting with respect to each color ink used for color printing.

SUMMARY OF THE INVENTION

An object of the present invention is to improve image quality by alleviating printing positional deviation arising between forward and reverse passes in the main scanning direction during bi-directional printing.

To resolve at least some of the above problems, the present invention provides a printing apparatus that includes a print head equipped with nozzle groups for printing dots on a print medium by the emission of ink droplets. When printing on the print medium during forward and reverse main scanning passes, the following processing is performed. In a monochrome printing mode in which only ink droplets of an achromatic color are used, a first correction value is used to correct printing positional deviation of the ink droplets arising between forward and reverse main scanning passes. And, in a color printing mode in which ink droplets of chromatic colors are used, a second correction value is used to correct printing positional deviation of ink droplets.

During monochrome printing this enables the printing position to be corrected using a first correction value suitable for monochrome printing, while during color printing it enables positional deviation to be corrected using a second correction value suitable for color printing.

It is preferable to set the second correction value to reduce printing positional deviation of ink droplets of a target color selected from the chromatic colors. This enables the setting of an optimum second correction value that selectively takes into consideration only inks that strongly need to be thus taken into account.

When the print head has a plurality of single-chromatic-color nozzle groups including a cyan nozzle group and a magenta nozzle group, the second correction value can be set to reduce the printing positional deviation of the cyan ink droplets and the magenta ink droplets. Because positional deviation of cyan and magenta dots is more noticeable than those of other colors, the overall quality of the color printing can be improved by using second correction values set to reduce such positional deviation of cyan and magenta dots.

Also, when the plurality of single-chromatic-color nozzle groups includes a light cyan nozzle group and a light magenta nozzle group, the second correction value can be set to reduce the printing positional deviation of the light cyan ink droplets and the light magenta ink droplets. Because light cyan and light magenta are the inks used most extensively in halftone regions of color images and the positional precision of dots printed in these colors has a major effect on the image quality, the image quality of the color printing can be improved by using second correction values set to reduce such positional deviation of light cyan and light magenta dots.

It is also preferable to set the first correction value according to correction information indicative of a preferred correction state that is selected from among a first test pattern of positional deviation printed using the achromatic-color nozzle group, and to set the second correction value according to correction information indicative of a preferred correction state that is selected from among a second test pattern of positional deviation printed using at least one chromatic-color nozzle group.

In accordance with this arrangement, a pattern printed using the actual achromatic color nozzle group can be used to determine a first correction value that will enable positional deviation of achromatic color ink dots to be reduced. Similarly, a pattern printed actually using the chromatic-color nozzle group can be used to determine a second correction value that will enable positional deviation of the chromatic color ink dots.

Also, when the plurality of single-chromatic-color nozzle groups includes a cyan nozzle group and a magenta nozzle group, it is preferable that a second test pattern of positional deviation includes a second forward pass sub-pattern printed during a main scanning forward pass using either the cyan nozzle group or the magenta nozzle group, and a second reverse pass sub-pattern printed during a main scanning reverse pass using whichever of the cyan nozzle group and the magenta nozzle group was not used to print the second forward pass pattern.

Normally when a positional deviation test pattern is used to set a correction value to reduce positional deviation of both cyan ink dots and magenta ink dots, it is necessary to print both forward and reverse pass test patterns in each ink.

And, then it is necessary to use these to set optimum correction values for each ink, and then use the two correction values to determine the final correction value. However, by using the arrangement described above, a correction value can be determined that applies to both inks by printing just one set of forward and reverse pass test patterns. That is, it is not necessary to print forward and reverse pass test patterns for each ink.

Furthermore, when the bi-directional printing apparatus is capable of performing main scanning at a plurality of main scanning velocities, the second correction values may be applied independently to each of the plurality of main scanning velocities. Similarly, the first correction values may be applied independently to the plurality of main scanning velocities. Since the relative degree of printing positional deviation depends on the main scanning velocity, such deviation can be effectively reduced by applying the first and second correction values independently for each main scanning velocity.

Also, when the bi-directional printing apparatus is capable of emitting ink in a plurality of dot emission modes of mutually different ink emission velocities, the first and the second correction values may be applied independently to each of the plurality of dot emission modes. As the degree of positional deviation depends also on the ink emission velocity, such deviation can also be effectively reduced by thus applying the first and second correction values independently for each ink emission velocity.

A common second correction value can also be applied to the chromatic-color nozzle groups. Moreover, when achromatic color ink is also used in a color printing mode, a common second correction value can be applied to both the chromatic- and achromatic-color nozzle groups, thereby simplifying the processing.

Alternatively, the second correction value can be set independently to each of the single-chromatic-color nozzle groups, enabling deviation to be even more effectively reduced on a single-chromatic-color nozzle group by group basis.

The second correction value may be set independently to the sets of groups of single-chromatic-color nozzles that emit the same color ink. As the degree of positional deviation depends also on the property of the ink, such deviation can also be effectively reduced by thus applying the first and second correction values independently for each ink.

The memory for storing the first and second correction values may be a non-volatile memory provided in the printing apparatus.

It is preferable for the non-volatile memory to be attached to the print head, so as to be detachably attached to the printing apparatus with the print head. Thus, even after a print head is replaced, the second correction values used to correct printing positional deviation will be the proper ones for that new print head.

Specific aspects of the invention can be applied to various types of printing apparatus, printing methods, computer programs for implementing the printing apparatus or printing methods, computer program products storing the computer programs, and data signals embodied in a carrier wave including the computer programs.

These and other objects, features, aspects, and advantages of the present invention will become more apparent from the following detailed description of the preferred embodiments with the accompanying drawings.

DESCRIPTION OF THE PREFERRED EMBODIMENT

Modes of carrying out the invention will now be explained in the following order, with reference to the embodiments.

A. Apparatus configuration:

B. Generation of printing positional deviation between nozzle rows:

C. First embodiment (correction of printing positional deviation using reference and relative correction values (1)):

D. Second embodiment (correction of printing positional deviation using reference and relative correction values (2)):

E. Third embodiment (correction of printing positional deviation between dots using absolute correction values):

F. Modifications:

A. Apparatus Configuration

Figure 1:
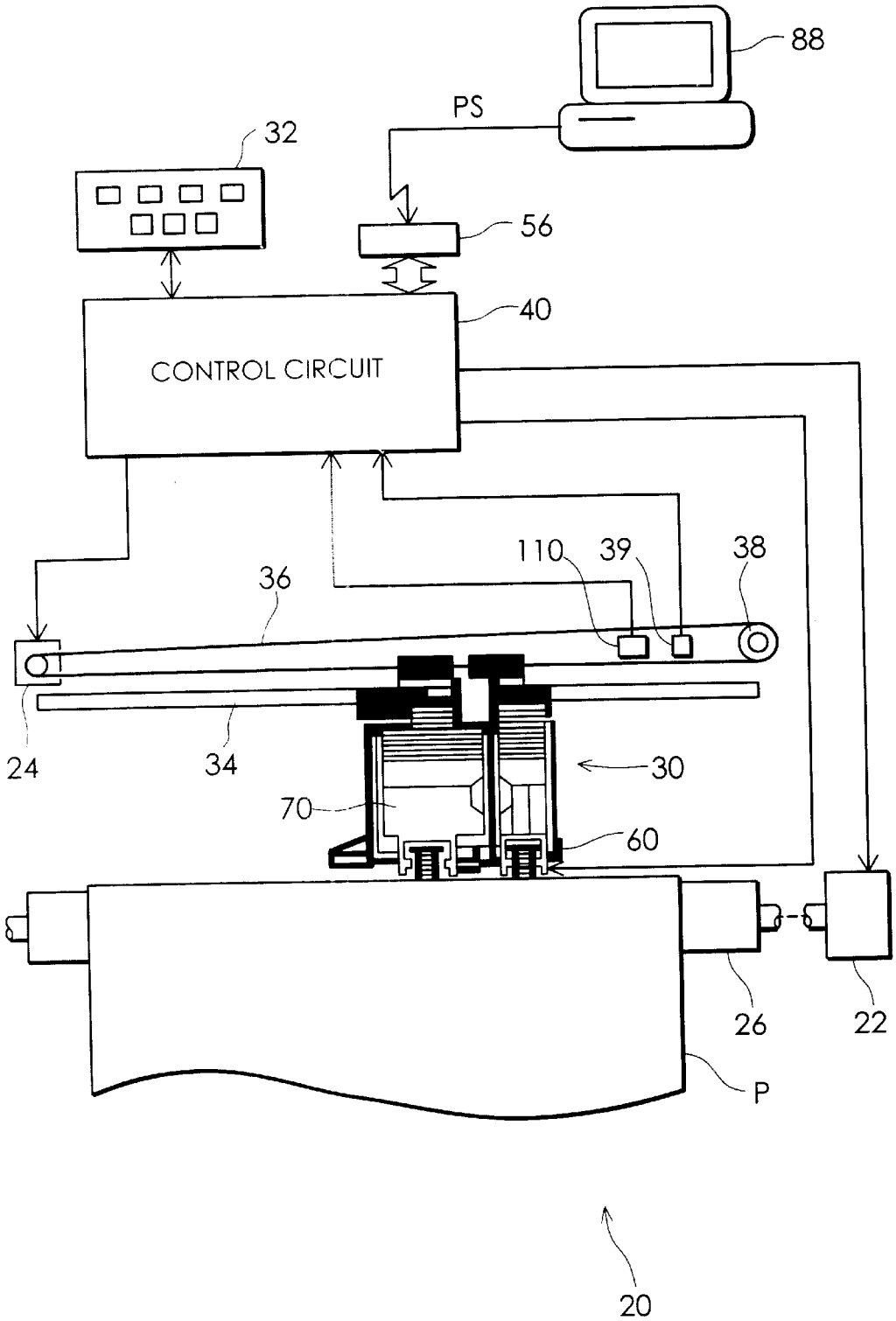
FIG. 1 shows the general configuration of a printing system equipped with a printer 20 of the first embodiment.

FIG. 1 shows the general configuration of a printing system provided with an inkjet printer 20, constituting a first embodiment of the invention. The inkjet printer 20 includes a sub-scanning feed mechanism that uses a paper feed motor 22 to transport the printing paper P, a main scanning mechanism that uses a carriage motor 24 to effect reciprocating movement of a carriage 30 in the axial (main scanning) direction of a platen 26, a head drive mechanism that drives a print head unit 60 (also referred to as a print head assembly) mounted on the carriage 30 and controls ink emission and dot formation, and a control circuit 40 that controls signal traffic between a control panel 32 and the feed motor 22, the carriage motor 24 and the print-head unit 60. The control circuit 40 is connected to a computer 88 via a connector 56.

The sub-scanning feed mechanism that transports the paper P includes a gear-train (not shown) that transmits the rotation of the feed motor 22 to paper transport rollers (not shown). The main scanning feed mechanism that reciprocates the carriage 30 includes a slide-shaft 34 that sidably supports the carriage 30 and is disposed parallel to the shaft of the platen 26, a pulley 38 connected to the carriage motor 24 by an endless drive belt 36, and a position sensor 39 for detecting the starting position of the carriage 30.

Figure 2:
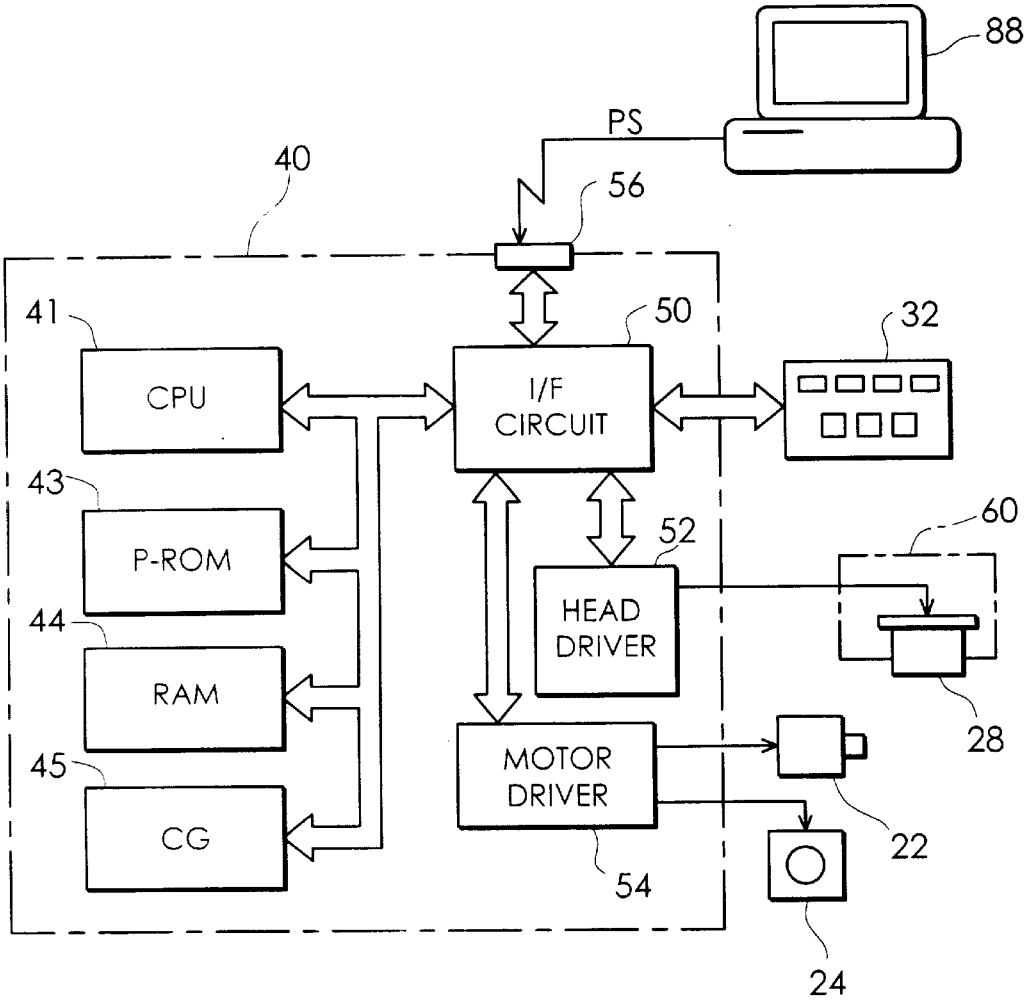
FIG. 2 is a block diagram showing the configuration of a control circuit 40 of the printer 20.

FIG. 2 is a block diagram showing the configuration of the inkjet printer 20 centering on the control circuit 40. The control circuit 40 is configured as an arithmetical logic processing circuit that includes a CPU 41, a programmable ROM (PROM) 43, RAM 44, and a character generator (CG) 45 in which is stored a character matrix. The control circuit 40 is also provided with an interface (I/F) circuit 50 for interfacing with external motors and the like, a head drive circuit 52 that is connected to the I/F circuit 50 and drives the print head unit 60 to emit ink, and a motor drive circuit 54 that drives the feed motor 22 and the carriage motor 24. The I/F circuit 50 incorporates a parallel interface circuit and, via the connector 56, can receive print signals PS from the computer 88.

Figure 3:
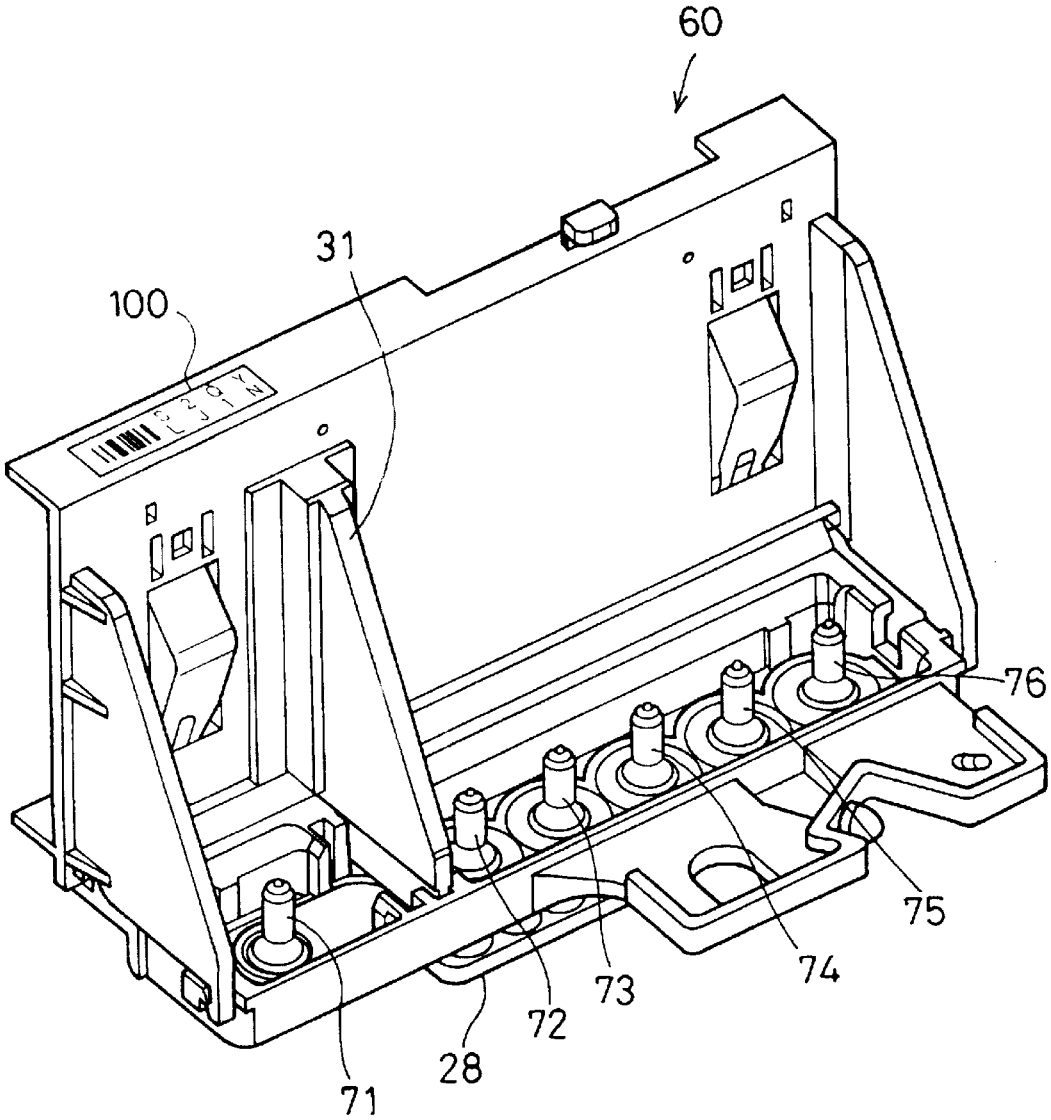
FIG. 3 is a perspective view of a print head unit 60.

FIG. 3 is a diagram illustrating a specific configuration of the print head unit 60. As can be seen, the print head unit 60 is L-shaped, and can hold black and colored ink cartridges (not shown). The print head unit 60 is provided with a divider plate 31 to allow both cartridges to be installed.

An ID seal 100 is provided on the top edge of the print head unit 60. The ID seal 100 displays head identification information pertaining to the print head unit 60. Details of the head identification information provided by the ID seal 100 are described later.

The print head unit 60 constituted by the print head 28 and the ink cartridge holders is so called since it is removably installed in the inkjet printer 20 as a single component. That is, when a print head 28 is to be replaced, it is the print head unit 60 itself that is replaced.

The bottom part of the print head unit 60 is provided with ink channels 71 to 76 via which ink from ink tanks is supplied to the print head 28. When black and colored ink cartridges are pressed down onto the print head unit 60, the ink channels 71 to 76 are inserted into the respective ink chambers of the cartridges.

Figure 4:
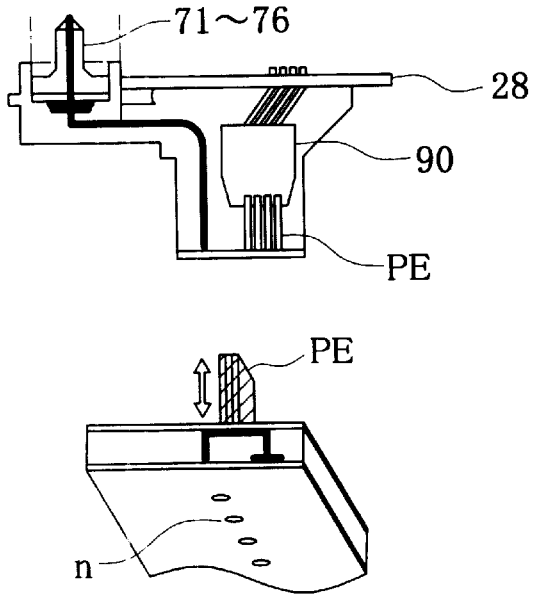
FIG. 4 illustrates the ink emission structure of the print head.

FIG. 4 illustrates the mechanism used to emit ink. When ink cartridges are installed on the print head unit 60, ink from the cartridges is drawn out via the ink channels 71 to 76 and channeled to the print head 28 provided on the underside of the print head unit 60.

For each color, the print head 28 has a plurality of nozzles n arranged in a line, and an actuator circuit 90 for activating a piezoelectric element PE with which each nozzle n is provided. The actuator circuit 90 is a part of the head drive circuit 52 (FIG. 2), and controls the switching on and off drive signals supplied from a drive signal generator (not shown). Specifically, for each nozzle, in accordance with a print signal PS supplied from the computer 88 the actuator circuit 90 is latched on (ink is emitted) or off (ink is not emitted), and applies a drive signal to piezoelectric elements PE only in respect of nozzles that are switched on.

Figure 5A:
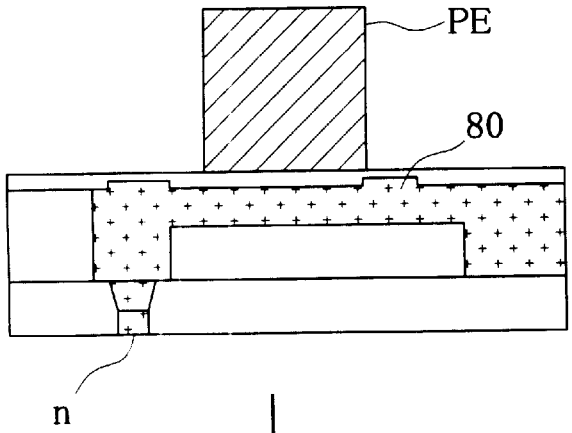
FIGS. 5(A) and 5(B) illustrate the arrangement whereby ink particles Ip are emitted by the expansion of a piezoelectric element PE.
Figure 5B:
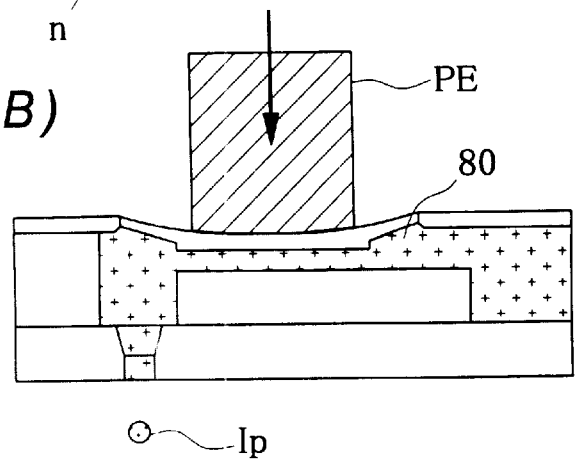

FIGS. 5(A) and 5(B) illustrate the principle based on which a nozzle n is driven by the piezoelectric element PE. The piezoelectric element PE is provided at a position where it is in contact with an ink passage 80 via which ink flows to the nozzle n. In this embodiment, when a voltage of prescribed duration is applied across the electrodes of the piezoelectric element PE, the piezoelectric element PE rapidly expands, deforming a wall of the ink channel 80, as shown in FIG. 5(B). This reduces the volume of the ink channel 80 by an amount corresponding to the expansion of the piezoelectric element PE, thereby expelling a corresponding amount of ink in the form of a particle Ip that is emitted at high speed from the nozzle n. Printing is effected by these ink particles Ip soaking into the paper P on the platen 26.

Figure 6:
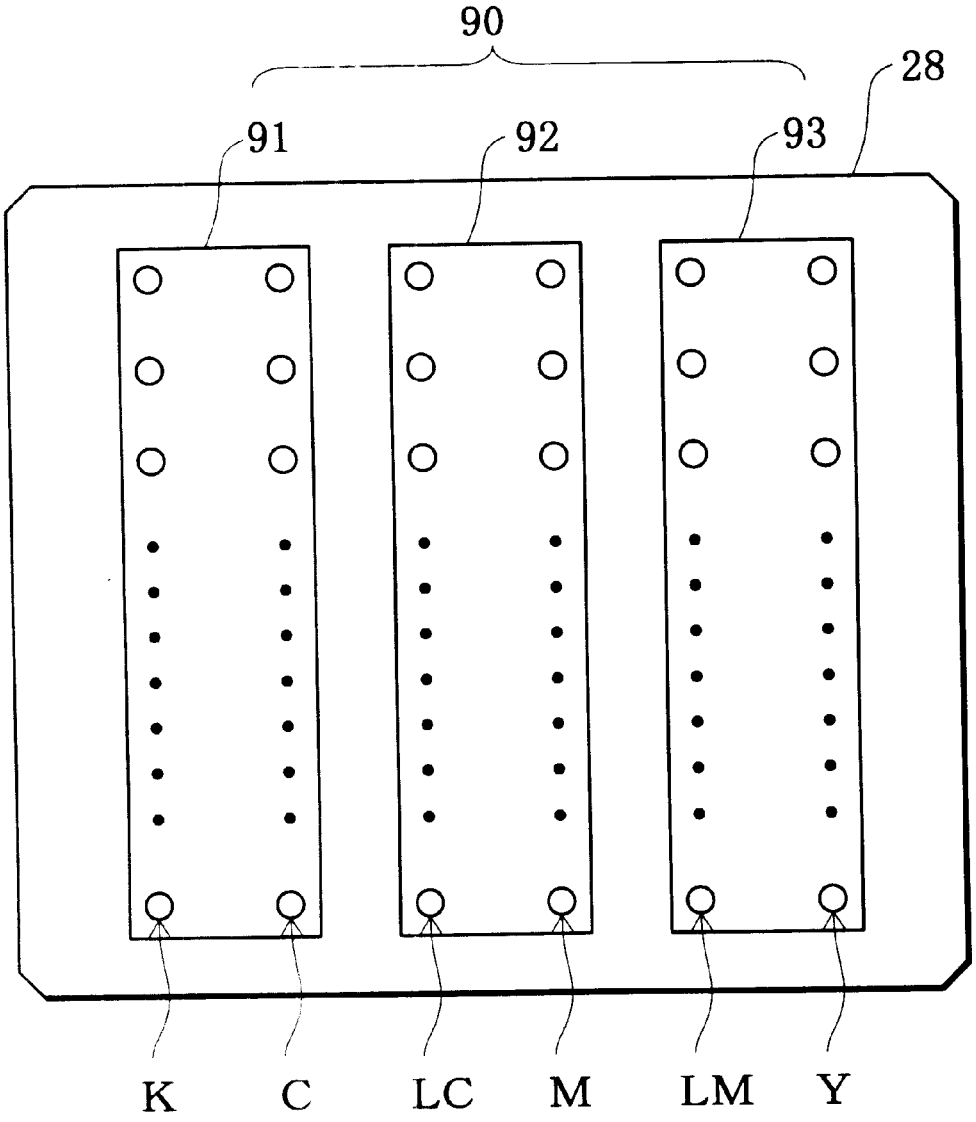
FIG. 6 is a diagram illustrating the positional relationship between the rows of nozzles in the print head 28 and the actuator chips.

FIG. 6 is a diagram illustrating the positional relationship between the rows of nozzles in the print head 28 and the actuator chips. The inkjet printer 20 prints using inks of the six colors black (K), dark cyan (C), light cyan (LC), dark magenta (M), light magenta (IM) and yellow (Y), and has a row of nozzles for each color. Dark cyan and light cyan are cyan inks of different density having more or less the same hue. This is also the case with respect to dark magenta and light magenta.

The actuator circuit 90 is provided with a first actuator chip 91 that drives the row of black ink nozzles K and the row of dark cyan ink nozzles C, a second actuator chip 92 that drives the row of row of light cyan ink nozzles LC and the row of dark magenta ink nozzles M, and a third actuator chip 93 that drives the row of light magenta ink nozzles LM and the row of yellow ink nozzles Y.

Figure 7:
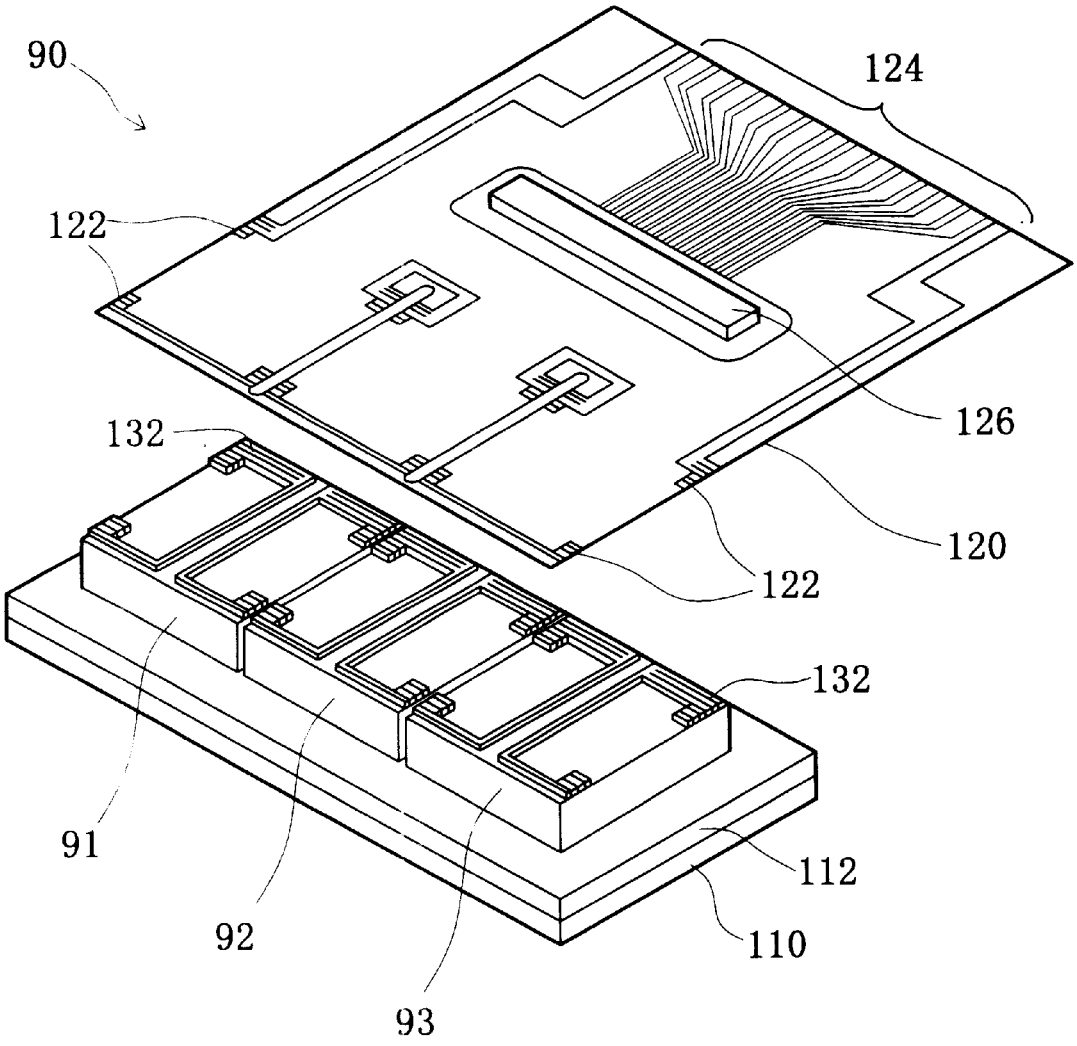
FIG. 7 is an exploded perspective view of the actuator circuit 90.

FIG. 7 is an exploded perspective view of the actuator circuit 90. Using adhesive, the three actuator chips 91 to 93 are bonded to the top of a laminated assembly comprised of a nozzle plate 110 and a reservoir plate 112. A contact terminal plate 120 is affixed over the actuator chips 91 to 93. Formed on one edge of the contact terminal plate 120 are terminals 124 for forming electrical connections with an external circuit (specifically the I/F circuit 50 of FIG. 2). Provided on the underside of the contact terminal plate 120 are internal contact terminals 122 for connecting the actuator chips 91 to 93. A driver IC 126 is provided on the contact terminal plate 120. The driver IC 126 has circuitry for latching print signals supplied from the computer 88, and an analogue switch for switching drive signals on and off in accordance with the print signals. The connecting wiring between the driver IC 126 and the terminals 122 and 124 is not shown.

Figure 8:
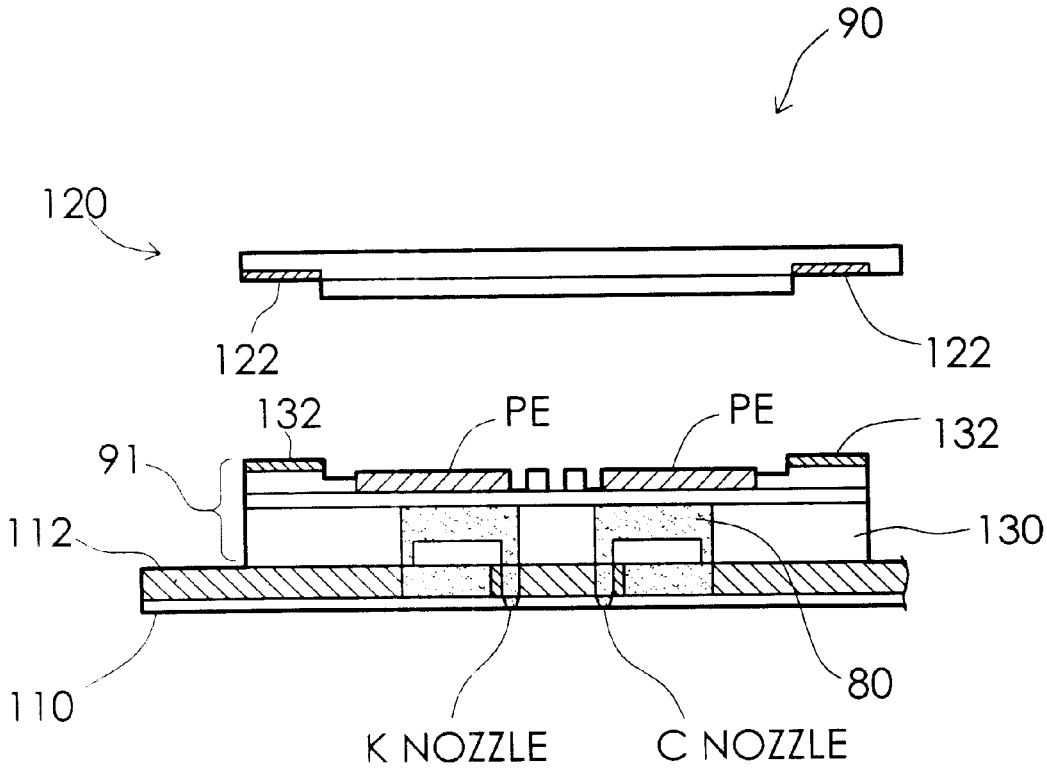
FIG. 8 is a partial cross-sectional view of the actuator circuit 90.

FIG. 8 is a partial cross-sectional view of the actuator circuit 90. This only shows the first actuator chip 91 and the terminal plate 120 in cross-section. However, the other actuator chips 92 and 93 have the same structure as that of the first actuator chip 91.

The nozzle plate 110 has nozzle openings for the inks of each color. The reservoir plate 112 is shaped to form a reservoir space to hold the ink. The actuator chip 91 has a ceramic sintered portion 130 that forms the ink passage 80 (FIG. 5), and on the other side of the upper wall over the ceramic sintered portion 130, piezoelectric elements PE and terminal electrodes 132. When the contact terminal plate 120 is affixed onto the actuator chip 91, electrical contact is formed between the contact terminals 122 on the underside of the contact terminal plate 120 and the terminal electrodes 132 on the upper side of the actuator chip 91. The connecting wiring between the terminal electrodes 132 and the piezoelectric element PE is not shown.

B. Generation of Printing Positional Deviation Between Nozzle Rows

In the first and second embodiments described below, printing positional deviation arising between rows of nozzles during bi-directional printing is adjusted. Before describi-ng the embodiments, an explanation will be given concerning the printing positional deviation arising between nozzle rows.

Figure 9:
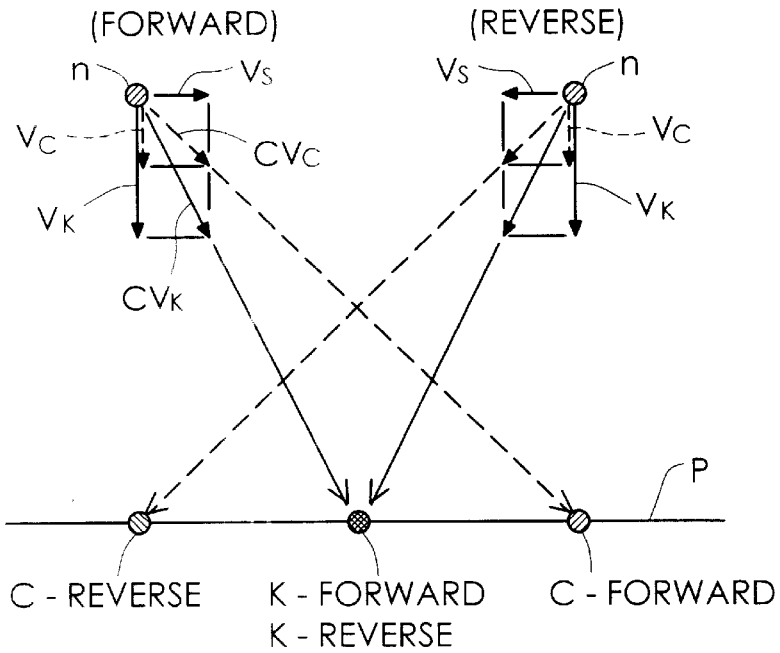
FIG. 9 illustrates positional deviation arising between rows of nozzles during bi-directional printing.

FIG. 9 illustrates positional deviation arising between rows of nozzles during bi-directional printing. Nozzle n is moved horizontally bi-directionally over the paper P with ink being emitted during forward and reverse passes to thereby form dots on the paper P. The drawing shows emission of black ink K and that of cyan ink C. $V_K$ is the emission velocity of black ink K emitted straight down, and $V_C$ is the emission velocity of cyan ink C, which is lower than $V_K$. The composite velocity vectors $CV_K$, $CV_C$ of the respective inks are given by the result of the downward emission velocity vector and the main scanning velocity $V_S$ of the nozzle n. Black ink K and cyan ink C have different downward emission velocities $V_K$ and $V_C$, so the magnitude and direction of the composite velocities $CV_K$ and $CV_C$ also differ.

In the example of FIG. 9, correction is applied so that positional deviation during bi-directional printing is reduced to zero with reference to black dots. However, since the composite velocity vector $CV_C$ of cyan ink C is different from the composite velocity vector $CV_K$ of black ink K, if the same emission timing is used for black ink K and cyan ink C, the result will be major deviation in the position of the printed cyan dots. Also, it can be seen that the relative positional relationship between black dots and cyan dots during a forward pass is reversed during the reverse pass.

Figure 10:
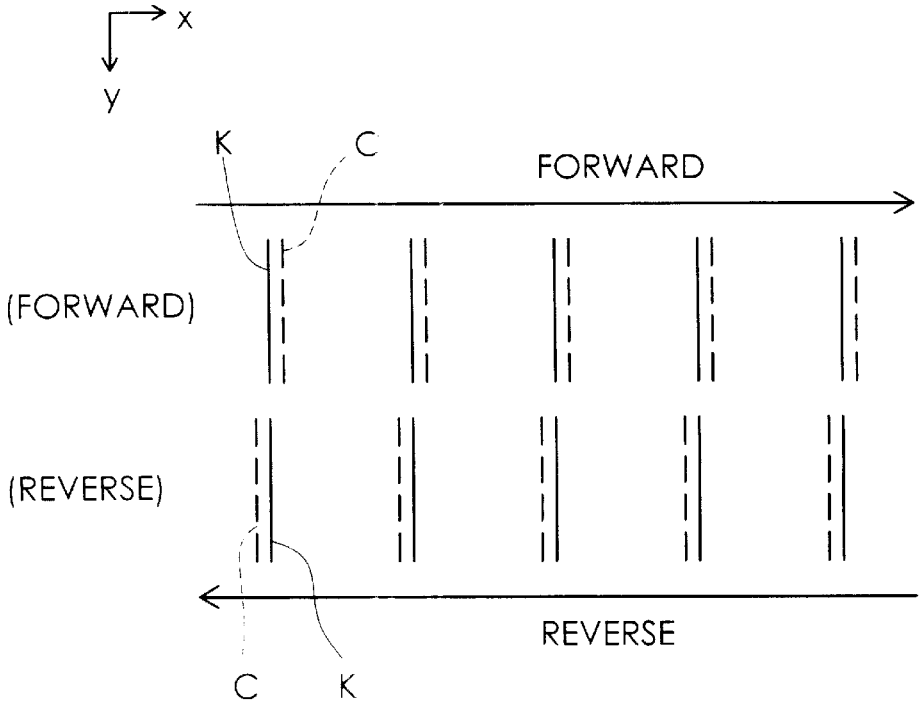
FIG. 10 is a plan view illustrating the printing positional deviation of FIG. 9.

FIG. 10 is a plan view illustrating the printing positional deviation of FIG. 9. The vertical lines in the sub-scanning direction y indicate printing in black ink K and cyan ink C. The vertical lines in black ink K printed during a forward pass are in alignment with the vertical lines printed during the reverse pass at positions in the main scanning direction x. On the other hand, the vertical lines printed in cyan ink on a forward pass are printed to the right of the black ink lines, and on the reverse pass are printed to the left of the black lines.

Thus, when positional deviation is corrected just with respect to printing by the row of black ink nozzles, there have been cases in which, with respect to other rows of nozzles, positional deviation could not be properly corrected.

The velocity of ink droplets emitted from the nozzles depends on the types of factors listed below.

(1) Manufacturing tolerance of the actuator chips.

(2) Physical qualities of the ink (viscosity, for example).

(3) Mass of ink droplets.

When the main factor affecting ink droplet emission velocity is the manufacturing tolerance of the actuator chips, the ink droplets emitted by the same actuator chip are emitted at substantially the same velocity. Therefore, in correcting for positional deviation in the main scanning direction in such a case, it is preferable to effect such correction on a nozzle group by group basis, for each group of nozzles driven by different actuators.

When the physical properties of the ink or the mass of the ink droplets have a major effect on emission velocity, it is preferable to correct for positional deviation of dots printed in the main scanning direction ink by ink or nozzle row by nozzle row.

C. First Embodiment (Correction of Printing Positional Deviation Using Reference and Relative Correction Values (1))

Figure 11:
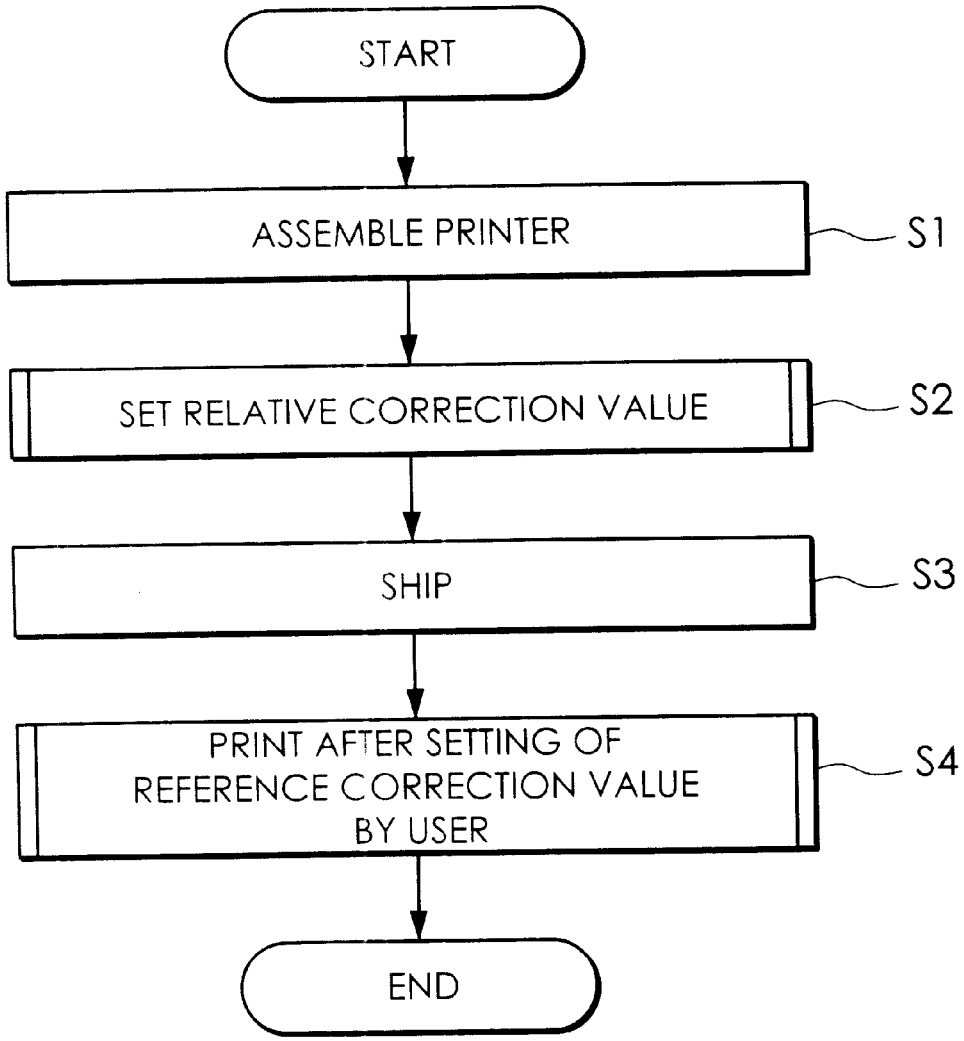
FIG. 11 is a flow chart of the overall processing by the first embodiment.

FIG. 11 is a flow chart of the process steps in a first embodiment of the invention. In step S1, the printer 20 is assembled on the production line, and in step S2 an operator sets relative correction values for correcting positional deviation in the printer 20. In step S3 the printer 20 is shipped from the factory, and in step S4, the purchaser of the printer 20 prints after setting a reference correction value for correcting positional deviation during use. Steps S2 and S4 will be each described in more detail below.

Figure 12:
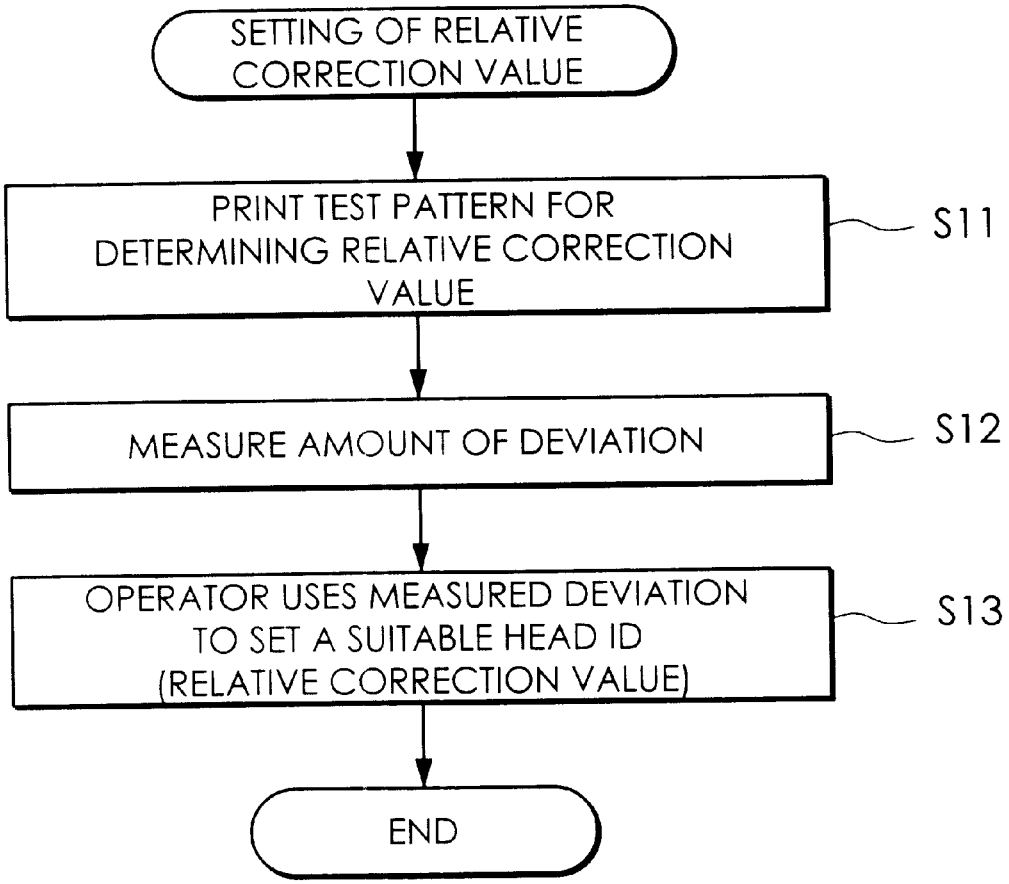
FIG. 12 is a flow chart showing the details of the step S2 procedure of FIG. 11.
Figures 13, 14:
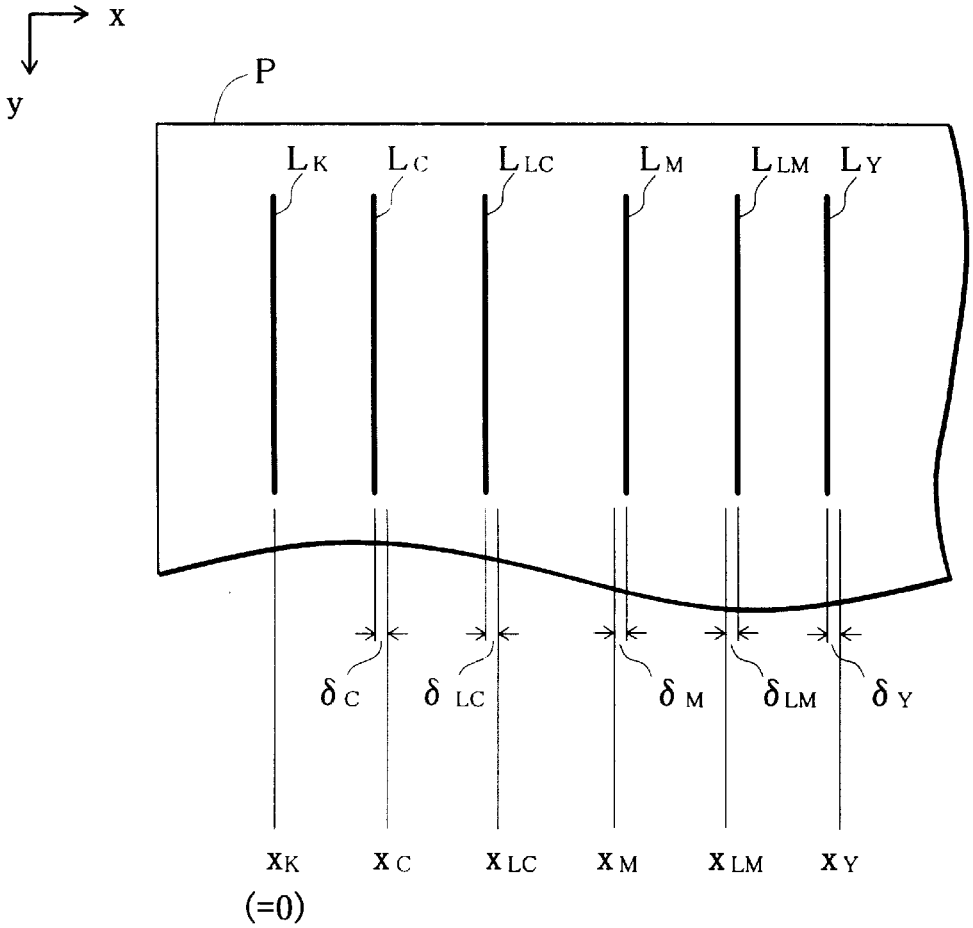
FIG. 13 is an example of a test pattern used to determine a relative correction value.
FIG. 14 shows the relationship between the relative correction value Δ and head ID.

FIG. 12 is a flow chart showing details of the step S2 of FIG. 11. In step S11, a test pattern is printed to determine relative correction values. FIG. 13 shows an example of such a test pattern. The test pattern consists of the six vertical lines $L_K$, $L_C$, $L_{LC}$, $L_{LM}$, $L_M$, $L_Y$ formed in the sub-scanning direction y in the six colors K, C, LC, M, LM, Y. The six lines were printed by ink emitted from the six rows of nozzles simultaneously while moving the carriage 30 at a set speed. In each main scanning pass the dots were formed spaced apart by just the nozzle pitch in the sub-scanning direction, so in order to print the vertical lines as shown in FIG. 13, ink was emitted at the same timing during a plurality of main scanning passes.

The test pattern does not have to be composed of vertical lines, but may be any pattern of straight lines of dots printed at intervals. This also applies to test patterns for determining a reference correction value described later.

In step S12 of FIG. 12, the amounts of deviation between the six vertical lines of FIG. 13 are measured. This can be measured by, for example, using a CCD camera to read the test pattern and using image processing to measure the positions of the lines $L_K$, $L_C$, $L_{LC}$, $L_M$, $L_{ML}$, $L_Y$ in the main scanning direction x. The six vertical lines are formed simultaneously by the emission of ink from the six rows of nozzles, so if the ink is considered as being emitted at the same velocity from the six sets of nozzles, the spacing of the six lines should be the same as the spacing of the rows of nozzles.

The x coordinates $X_C$, $X_{LC}$, $X_M$, $X_{LM}$, $X_Y$ shown in FIG. 13 indicate the ideal coordinates of the lines in accordance with the design pitches of the nozzle rows while the x coordinate value $X_K$ of the black ink line $L_K$is used as a reference. Thus, the positions denoted by the x coordinates $X_C$, $X_{LC}$, $X_M$, $X_{LM}$, $X_Y$ will be also referred to hereinafter as the design positions. The amount of deviation $\delta_C$, $\delta_{LC}$, $\delta_{LM}$, $\delta_{LM}$, $\delta_Y$ of the five lines relative to the design position is measured. When the deviation is to the right of the design position the deviation amount δ is taken as a plus value, and a minus value when the deviation is to the left of the design position.

In step S13, the measured deviation amounts are used as a basis for an operator to determine a suitable head ID and set the head ID in the printer 20. The head ID indicates the suitable relative correction value to use for correcting the measured deviations. As shown by the following equation (1), for example, the suitable relative correction value Δ can be set at a value that is the negative of the average deviation value δave of the lines other than the reference line LK.

$$\Delta=-\delta ave=-\Sigma\delta i/(N-1) \quad (1)$$

where Σ denotes the arithmetical operation of obtaining the sum deviation δi of all lines other than the reference black ink line, and N denotes the total number of vertical lines, which is to say, the number of rows of nozzles.

FIG. 14 shows the relationship between relative correction value Δ and head ID. In this example, when the relative correction value Δ is −35.0 μm the head ID is set at 1, and the head ID is incremented by 1 for every 17.5 μm increase in the relative correction value Δ. Here, 17.5 μm is the minimum value by which the printer 20 can be adjusted for deviation in the main scanning direction. As this minimum adjustable value, there may be used a value that is the equivalent of the dot pitch in the main scanning direction. With respect to a printing resolution of 1440 dots per inch (dpi) in the main scanning direction, for example, the dot pitch is approximately 17.5 μm (=25.4 cm/1440), so that can be used as the minimum adjustable value. It is also possible to use a minimum adjustable value that is smaller than the dot pitch.

The head ID thus determined is stored in the PROM 43 (FIG. 2) in the printer 20. In this embodiment, a seal or label 100 showing the head ID is also provided on the top of the print head unit 60 (FIG. 3). It is also possible to provide the driver IC 126 in the print head unit 60 with a non-volatile memory, such as a PROM, and store the head ID in the non-volatile memory. The advantage of either method is that when the print head unit 60 is used in another printer 20, it enables the right head ID for that print head unit 60 to be used in the printer.

The determination of the relative correction value of step S2 can be carried out in the assembly step prior to the installation of the print head unit 60 into the printer 20, with a special inspection apparatus for testing the print head unit 60. In this case, the head ID can be stored in the PROM 43 during the subsequent installation of the print head unit 60 in the printer 20. In this case, the head ID can be stored in the PROM 43 of the printer 20 by using a special reader to read the head ID seal 100 on the print head unit 60 or an operator can use a keyboard to manually key in the head ID. alternatively, the head ID stored in non-volatile memory in the print head unit 60 can be transferred to the PROM 43.

The relative correction value A may be given by the average of the light cyan and light magenta deviation amounts, as in equation (2).

$$\Delta=-(\delta_{LC}+\delta_{LM})/2 \quad (2)$$

Light cyan and light magenta are used far more than other inks in halftone regions of color images (especially in the image density range of about 10 to 30% for cyan and/or magenta), so the positional precision of dots printed in these colors has a major effect on the image quality. Thus, using the average deviation of dots printed in light cyan and light magenta to determine the relative correction value Δ makes it possible to decrease the positional deviation, thereby improving the quality of the color images.

When using equation (2), it is enough just to measure the deviation δ from the black ink dots for light cyan and light magenta.

As shown in the flow chart of FIG. 11, the printer 20 is shipped after the head ID has been set in the printer 20. When the printer 20 is to be used, positional deviation during bi-directional printing is adjusted using the head ID.

Figure 15:
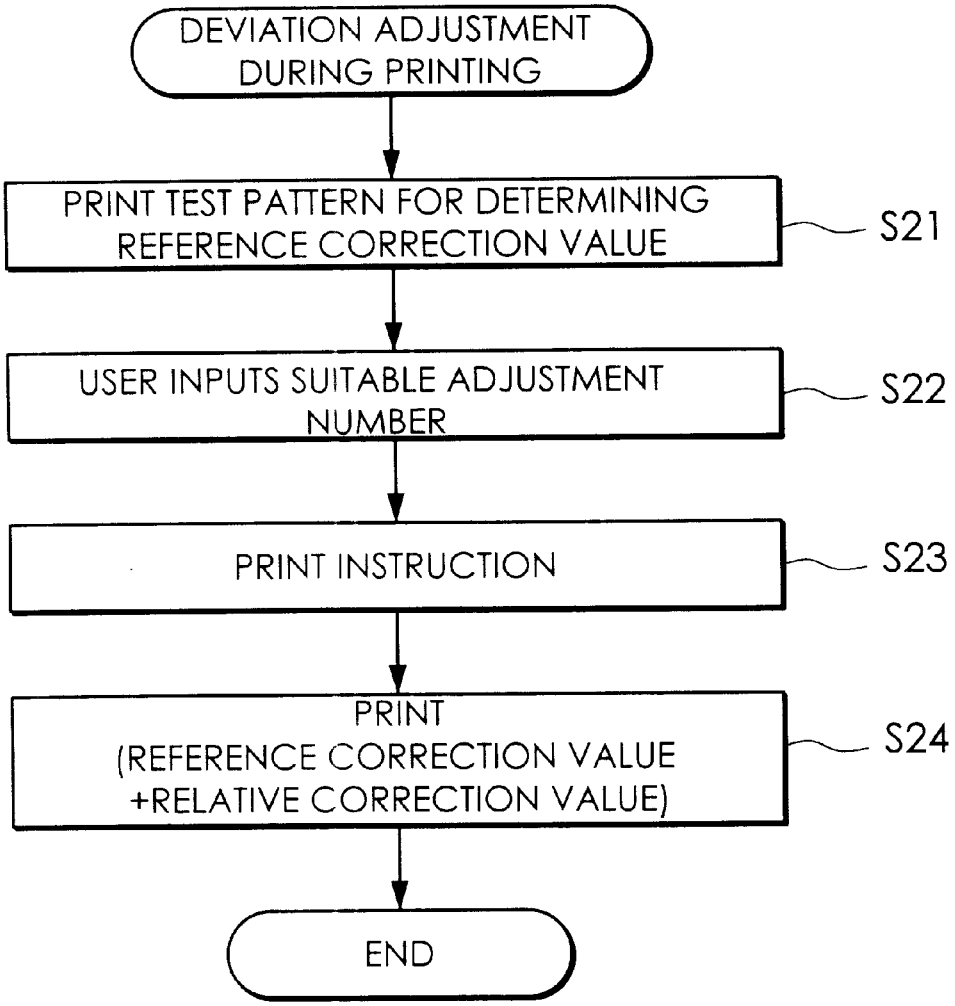
FIG. 15 is a flow chart showing the details of the step S4 procedure of FIG. 11.
Figure 16:
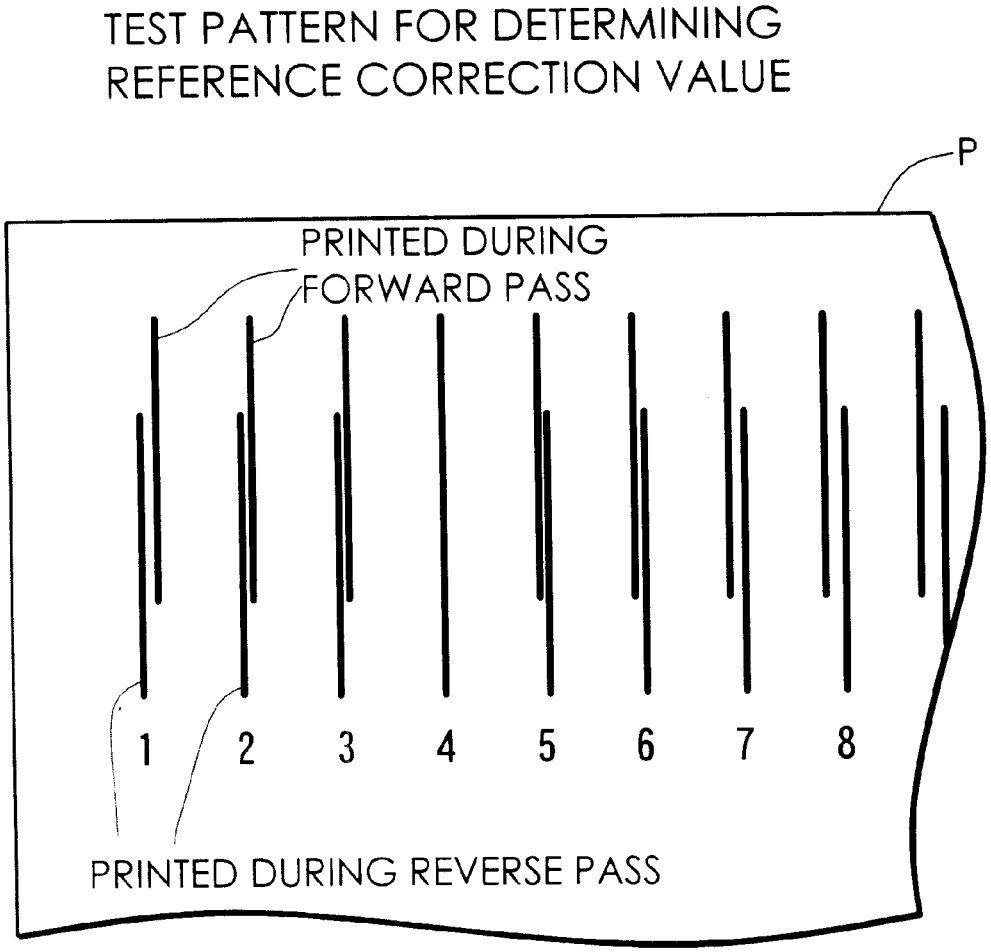
FIG. 16 is an example of a test pattern used to determine a reference correction value.

FIG. 15 is a flow chart of the deviation adjustment procedure carried out when the printer is used by the user. In step S21 the printer 20 is instructed to print out a test pattern to determine a reference correction value. FIG. 16 shows an example of such a test pattern. The test pattern consists of a number of vertical lines printed in black ink during forward and reverse passes. The lines printed during the forward pass are evenly spaced, but on the reverse pass the position of the lines is sequentially displaced along the main scanning direction in units of one dot pitch. As a result, multiple pairs of vertical lines are printed in which the positional deviation between lines printed during the forward and reverse passes increases by one dot pitch at a time. The numbers printed below the pairs of lines are deviation adjustment numbers denoting correction information required to achieve a preferred corrected state. A preferred corrected state refers to a state in which, when the printing position (and printing timing) during forward and reverse passes has been corrected using an appropriate reference correction value, the positions of dots formed during forward passes coincide with the positions of dots formed during reverse passes with respect to the main scanning direction. Thus, the preferred corrected state is achieved by the use of an appropriate reference correction value. In the example of FIG. 16, the pair of lines with the deviation adjustment number 4 are in a preferred corrected state.

The test pattern for determining the reference correction value is formed by a reference row of nozzles which has been used for determining the relative correction value. Therefore, when the row of magenta ink nozzles is used as the reference nozzle row in place of the row of black ink nozzles used for determining the relative correction value, the test pattern for determining the reference correction value is also formed using the row of magenta ink nozzles.

The user inspects the test pattern and uses a printer driver input interface screen (not shown) on the computer 88 to input the deviation adjustment number of the pair of vertical lines having the least deviation. The deviation adjustment number is stored in the PROM 43.

Figure 17:
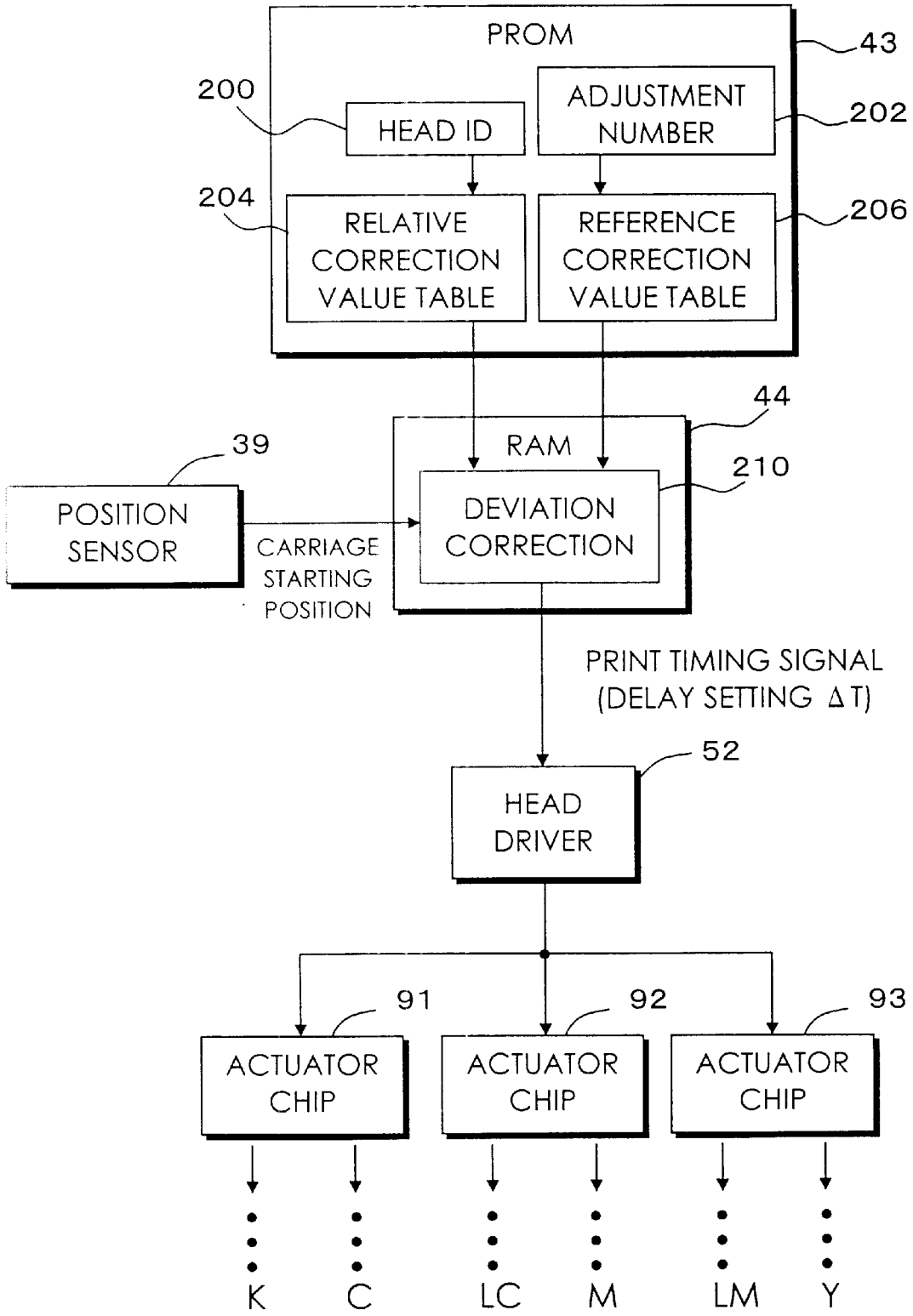
FIG. 17 is a block diagram of the main configuration involved in the correction of deviation arising during bi-directional printing in the case of the first embodiment.

Next, in step S23, the user instructs to start the printing, and in step S24, bi-directional printing is carried out while using the reference and relative correction values to correct deviation. FIG. 17 is a block diagram of the main configuration involved in the correction of deviation during bi-directional printing in the case of the first embodiment. The PROM 43 in the printer 20 has a head ID storage area 200, an adjustment number storage area 202, a relative correction value table 204 and a reference correction value table 206. A head ID indicating the preferred relative correction value is stored in the head ID storage area 200, and a deviation adjustment number indicating the preferred reference correction value is stored in the adjustment number storage area 202. The relative correction value table 204 is one such as that shown in FIG. 14, which shows the relationship between head ID and relative correction value Δ. The reference correction value table 206 is a table showing the relationship deviation adjustment number and reference correction value.

The RAM 44 in printer 20 is used to store a computer program that functions as a positional deviation correction section (adjustment value determination section) 210 for correcting positional deviation during bi-directional printing. The deviation correction section 210 reads out from the relative correction value table 204 a relative correction value corresponding to the head ID stored in the PROM 43, and also reads out from the reference correction value table 206 a reference correction value corresponding to the deviation adjustment number. During a reverse pass, when the deviation correction section 210 receives from the position sensor 39 a signal indicating the starting position of the carriage 30, it supplies the head drive circuit 52 with a printing timing signal (delay setting ΔT) that corresponds to a correction value that is a composite of the relative and reference correction values. The three actuator chips 91 to 93 in the head drive circuit 52 are supplied with common drive signals, whereby the positioning of dots printed during the reverse pass is adjusted in accordance with the timing supplied from the deviation correction section 210 (that is, by a delay setting ΔT). As a result, on the reverse pass, the printing positions of the six rows of nozzles are all adjusted by the same correction amount. When relative and reference correction amounts are both set at values that are integer multiples of the dot pitch in the main scanning direction, the printing position (meaning the printing timing) also is adjusted in dot pitch units in the main scanning direction. The composite correction value is obtained by adding the reference and relative correction values. Here, the lines printed during the reverse pass are set to be displaced by one dot pitch at a time, but if the line printing positions are set to be displaced in smaller units, correction values can be set that are integer multiples of those units. In other words, correction values can be set within a finer range by using finer settings for the displacement of lines printed during the reverse pass. The size of finest setting step is determined by the control abi-lity of the printer.

Figure 18A:
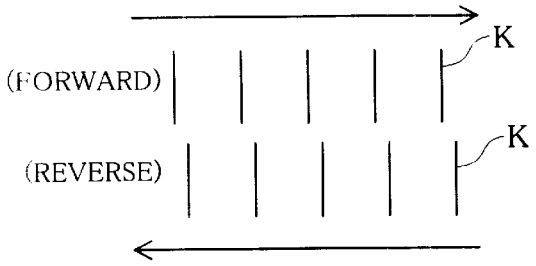
FIGS. 18(A)–18(D) illustrate the correction of positional deviation using reference and relative correction values, when black dots and cyan dots have been selected as the target dots.
Figure 18B:
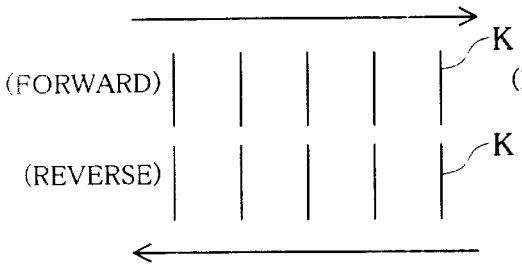
Figure 18C:
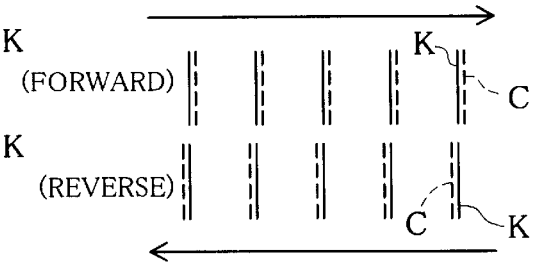
Figure 18D:
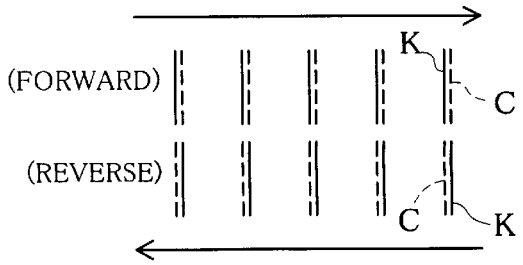

FIGS. 18(A)–18(D) illustrate the correction of positional deviation using reference and relative correction values. FIG. 18(A) shows deviation between vertical lines of black ink dots printed during forward and reverse passes without correction of the positional deviation. FIG. 18(B) shows the result of the positional deviation correction of the black lines using a reference correction value. Thus, correction using the reference correction value eliminated positional displacement of the black-dot lines during bi-directional printing. FIG. 18(C) shows the result of lines printed in cyan as well as black, using the same adjustment as in FIG. 18(B). As in FIG. 10, there is no deviation of the black lines, but there is quite a lot of deviation of the cyan lines. FIG. 18(1)) shows black lines and cyan lines printed after correction based on a reference correction value and after also applying a relative correction value $\Delta(=-\delta_C)$ to the cyan dots. This reduced deviation of the cyan dots, and slightly causes the deviation of the black dots. The overall result is that positional deviations of both black dots and cyan dots are decreased to be at about the same degree. In the example of FIG. 18(D), black dots and cyan dots were selected as the target dots to be subjected to positional correction, and correction of positional deviation is applied to those two types of dots.

Figure 19A:
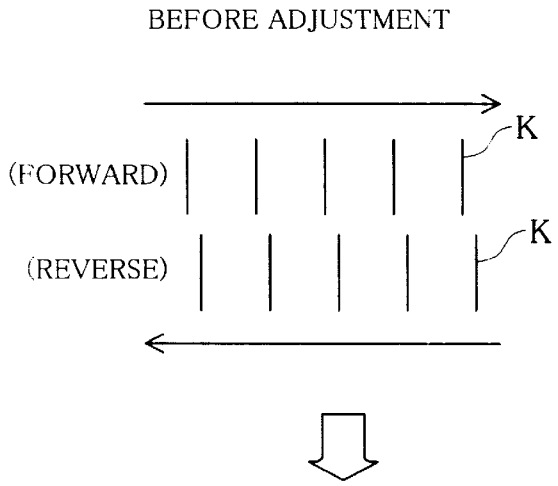
FIGS. 19(A)–19(D) illustrate the correction of positional deviation using reference and relative correction values, when only cyan dots have been selected as the target dots.
Figure 19B:
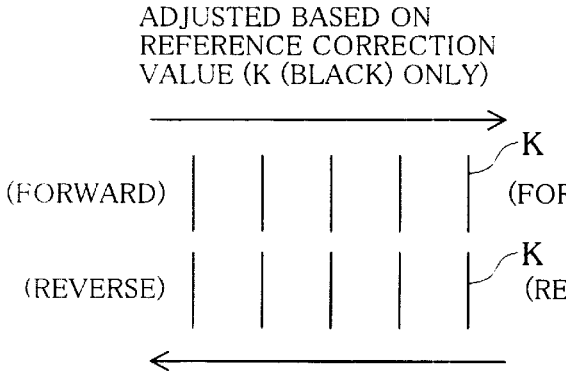
Figure 19C:
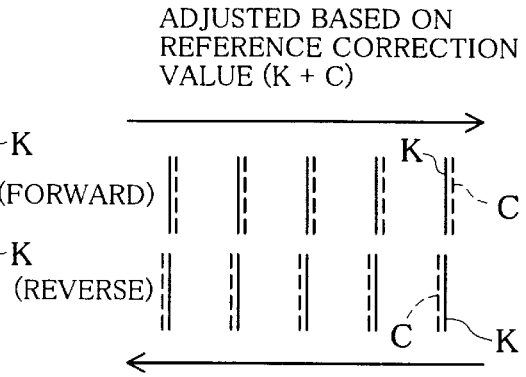
Figure 19D:
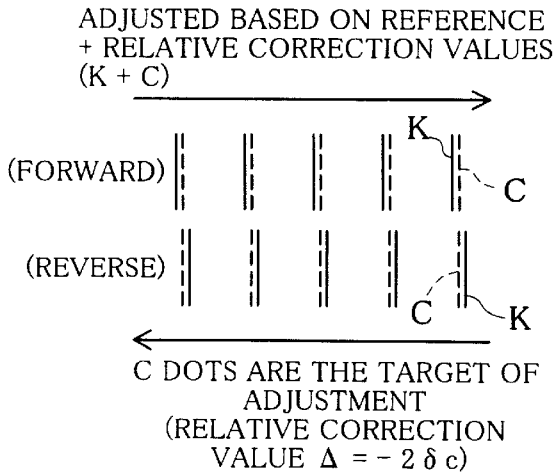

FIGS. 19(A)–19(D) illustrate correction of positional deviation applied to cyan dots only. The reference correction value used in FIG. 19(A) to FIG. 19(C) were the same as those applied in FIG. 18(A) to FIG. 18(C), while the value used in FIG. 19(D) differed from that used in FIG. 18(D). In the case of FIG. 19(D), the relative correction value Δ there is an inversion of twice the deviation amount $\delta_C$ of the cyan dots, or $-2\delta_C$, determined with the test pattern shown in FIG. 13. While this increases the deviation of the black dots, it reduces positional deviation of cyan dots to virtually to zero.

As can be understood from the examples shown in FIGS. 18(A)–18(D) and FIGS. 19(A)–19(D), when the deviation amount −δ of specific dots in the test pattern for determining relative correction values is used as the relative correction value Δ, both the specified dots and the reference dots (black dots) become the target dots for positional deviation correction, thereby making it possible to reduce positional deviation of these target dots. When twice the deviation amount −δ of specific dots of the test pattern for determining the relative correction value is used as the relative correction value Δ, only the specific dots are targeted for the positional deviation correction, making it possible to reduce the positional deviation of the target dots. Specifically, using the relative correction value $\Delta(=-(\delta_{LC}+\delta_{LM})/2)$ of equation (2) makes it possible to reduce positional deviations to be at the same degree in respect of three types of dots, black, light cyan and light magenta. Moreover, when the double value is used as the relative correction value, it is possible to reduce positional deviations to be at the same degree in respect of two types of dots, light cyan and light magenta. Similarly, when the relative correction value $\Delta(=-\delta ave)$ of equation (1) is used, it becomes possible to reduce positional deviations to be at the same degree in respect of all six types of dots. Also, when the double value is used as the relative correction value, it is possible to reduce positional deviations to be at the same degree in respect of all types of dots other than the black dots.

As revealed by FIG. 18(D) and FIG. 19(D), adjusting positional deviation based on the reference and relative correction values improves the quality of the color images by preventing the positional deviation of the dots of colored inks from becoming excessively large.

In monochrome printing colored inks are not used, so there is no need for the type of positional adjustment correction using relative correction values as shown in FIG. 18(D) and FIG. 19(D). Thus, in the case of monochrome printing it is preferable to apply deviation correction using just a reference correction value, as shown in FIG. 18(B). Thus, it is preferable to use a configuration whereby when the computer 88 instructs the printer control circuit 40 (specifically, the deviation correction section 210 shown in FIG. 17) to print in monochrome, just a reference correction value is used to correct positional deviation during bi-directional printing, and when the instruction is to print in color, both a reference correction value and a relative correction value are used to correct positional deviation during bi-directional printing.

Figure 22:
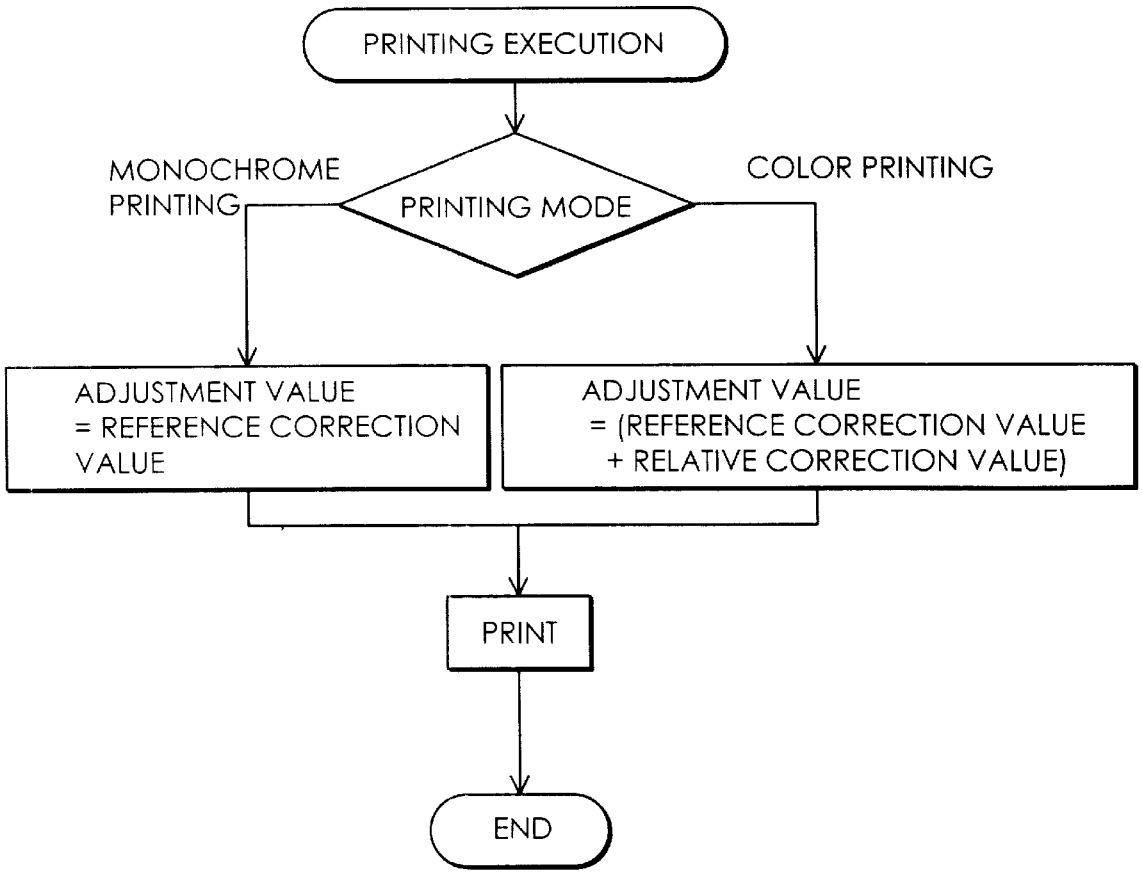
FIG. 22 is a flow chart of the process used to determine the adjustment values used to correct deviation during bi-directional printing.

FIG. 22 is a flow chart of the process used to determine the adjustment value used to correct deviation during bi-directional printing. When the printer control circuit 40 receives a notification of monochrome printing from the computer 88 (FIG. 1), it substitutes the reference correction value for the adjustment value and sends a printing timing signal to the head drive circuit 52. When the computer 88 sends a notification of color printing, the control circuit 40 substitutes the sum of the reference correction value and relative correction value for the adjustment value and sends a printing timing signal to the head drive circuit 52. Thus, in this first embodiment the reference correction value corresponds to a first correction value and the relative correction value corresponds to a second correction value of the claimed invention.

When it becomes necessary, for whatever reason, to replace the print head unit 60, the head ID of the new print head unit 60 is written into the PROM 43 in the control circuit 40 of the printer 20. This can be done in a number of ways. One way is for the user to use the computer 88 to input the head ID displayed on the head ID seal 100 attached to the print head unit 60 to the PROM 43. Another method is to retrieve the head ID from the non-volatile memory of the driver IC 126 (FIG. 7) and write it into the PROM 43. Thus storing in the PROM 43 the head ID of the new print head unit 60 ensures that positional deviation during bi-directional printing will be corrected using the suitable head ID (that is, the suitable relative correction value) for that print head unit 60.

As described in the foregoing, in accordance with this first embodiment a relative correction value is set for correcting positional deviation arising during bi-directional printing, with the row of black ink nozzles forming the reference for adjustment carried out in respect of the other rows of nozzles. Thus, this relative correction value and the reference correction value for black ink nozzles are used to correct positional deviation during bi-directional printing, thereby making it possible to improve the quality of the printed color images. An advantage is that a user does not have to make adjustments to correct positional deviation in respect of all inks, but only has to adjust for positional deviation in respect of the reference row of nozzles to achieve improved image quality during bi-directional printing of color images. In the case of monochrome printing, it is only necessary to use a reference correction value to correct for positional deviation during bi-directional printing, which is advantageous in that there is no degradation in the monochrome printing.

During monochrome printing positional deviation arising during bi-directional printing is corrected using only the reference correction value, and during color printing deviation is corrected using the reference correction value and the relative correction value. The advantage of this is that the resultant print image quality is improved in the case of both monochrome and color printing.

Figure 20:
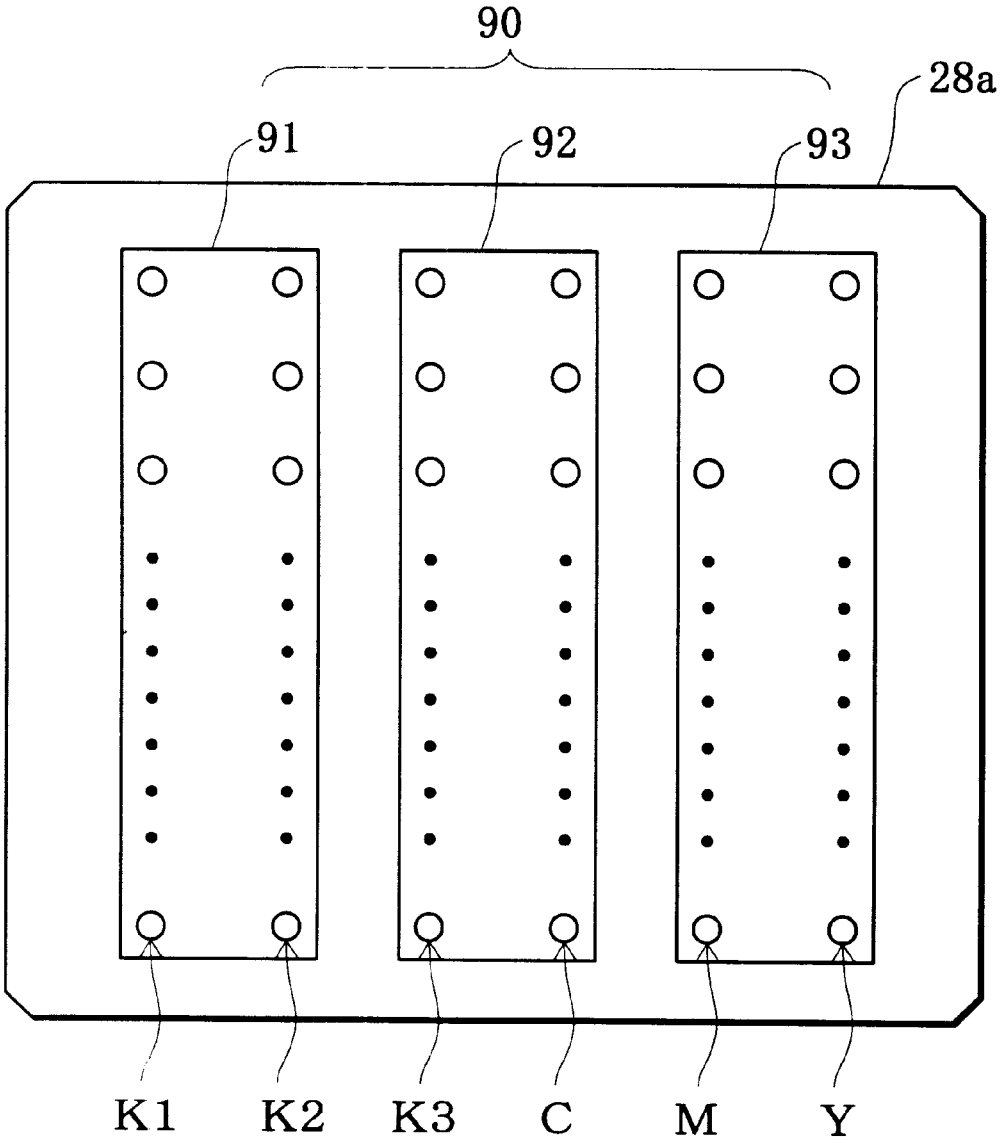
FIG. 20 illustrates the configuration of another print head 28*a*.

FIG. 20 illustrates another configuration of print head nozzles. In this example, print head 28a is provided with three rows of black (K) ink nozzles K1 to K3, and one row each of cyan (C), magenta (M) and yellow (Y) ink nozzles. During monochrome printing, the three rows of black ink nozzles can all be used, enabling high-speed printing. During color printing, the two rows of black ink nozzles K1 and K2 of the actuator chip 91 are not used, with printing being performed using the row of black ink nozzles K3 of actuator chip 92, together with the rows of cyan, magenta and yellow ink nozzles C, M and Y.

When printing in color using this head, the average of the cyan and magenta deviation amounts, or a value that is twice that value, as derived by equations (3a) and (3b), may be used as the relative correction value A during bi-directional color printing.

$$\Delta=-(\delta_C+\delta_M)/2 \tag{3a}$$

$$\Delta=-(\delta_C+\delta_M) \tag{3b}$$

$\delta_C$ and $\delta_M$ are relative deviation amounts for cyan and magenta measured from the vertical lines in the test pattern (FIG. 13) for determining the relative correction value while using the third row K3 of black ink nozzles as a reference.

When performing four-color printing without light inks, it is possible to improve the quality of the color images by using the average of the cyan and magenta deviation amounts to determine the relative correction value. The reason that yellow is disregarded is that yellow dots are not very noticeable, so that even if there is some deviation of yellow dots during bi-directional printing, this does not have any major effect on the image quality. However, the relative correction value may be determined based on the average of the cyan, magenta and yellow deviation amounts. That is to say, the relative correction value may be determined that is based on the average of the deviation amounts of all the rows of nozzles other than the reference row.

The relative correction value AK for non-reference black ink nozzle rows K1 and K2 with respect to the reference black ink nozzle row K3 may be obtained, in accordance with equation (4).

$$\Delta K=-(\delta_{K1}+\delta_{K2})/2 \tag{4}$$

where $\delta_{K1}$ is the deviation amount of the black dots formed with the row K1 and $\delta_{K2}$ is that of the black dots formed with the row K2.

Positional deviation arising during bi-directional monochrome printing using the three rows of black ink nozzles can be decreased by correcting deviation during bi-directional printing using relative correction value ΔK in respect of rows K1 and K2 and the reference correction value in respect of the reference row K3 (determined in FIG. 15). That is, when printing in monochrome using multiple rows of black ink nozzles, it is desirable to correct positional deviation during bi-directional printing by using a reference correction value in respect of a specific reference row of black ink nozzles, and a relative correction value in respect of the other rows of black ink nozzles.

D. Second Embodiment (Correction of Printing Positional Deviation Using Reference and Relative Correction Values (2))

Figure 21:
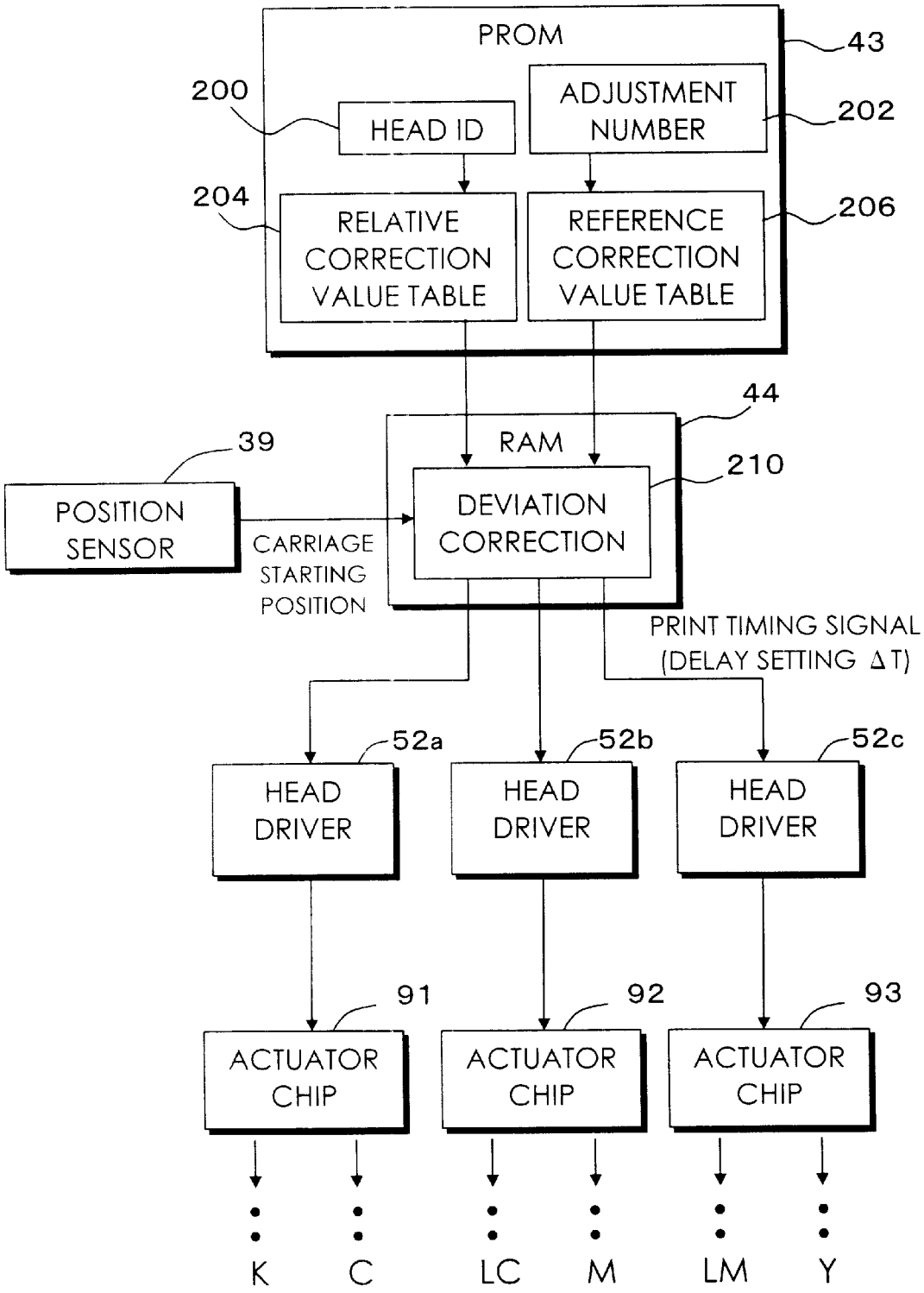
FIG. 21 is a block diagram of a control circuit 40*a* used in a second embodiment.

FIG. 21 is a block diagram of the main configuration involved in the correction of deviation during bi-directional printing in the second embodiment. The difference compared to the configuration of FIG. 17 is that each of the actuator chips 91, 92 and 93 is provided with its own, independent head drive circuit 52*a*, 52*b* and 52*c*. Thus, printing timing signals from the deviation correction section 210 can be independently applied to the head drive circuits 52*a*, 52*b* and 52*c*. Therefore, correction of positional deviation during bi-directional printing can also be effected on an actuator chip by chip basis.

In this second embodiment, too, the row K of black ink nozzles of the first actuator chip 91 is used as the reference. Thus, as in the first embodiment, the reference correction value is determined using a test pattern printed using the row K of black ink nozzles.

In this second embodiment a relative correction value is determined for each actuator chip. That is, as the relative correction value $\Delta_{91}$ for the first actuator chip 91, there can be used a value that is the negative of the deviation amount δc of the vertical lines printed using the row C of dark cyan nozzles, as per equation (4a).

$$\Delta_{91}=-\delta_C \tag{4a}$$

Also, as the relative correction values $\Delta_{92}$, $\Delta_{93}$ for the second and third actuator chips 92 and 93, there can be used values that are each the negative of the average deviation of the nozzle rows of each actuator chip, as per the following equations (4b) and (4c).

$$\Delta_{92}=-(\delta_{LC}+\delta_M)/2 \tag{4b}$$

$$\Delta_{93}=-(\delta_{LM}+\delta_Y)/2 \tag{4c}$$

Also, the relative correction values $\Delta_{92}$ and $\Delta_{93}$ for the second and third actuator chips 92 and 93 may be determined from the amount of printing positional deviation of one specific nozzle row from the reference nozzle row. In such a case, equations (5b) and (5c) can be used in place of equations (4b) and (4c).

$$\Delta_{92}=-\delta_{LC} \tag{5b}$$

$$\Delta_{92}=-\delta_{LM} \tag{5c}$$

The head ID representing the three relative correction values $\Delta_{91}$, $\Delta_{92}$ and $\Delta_{93}$ are stored in the PROM 43 of the printer 20. The deviation correction section 210 is supplied with the relative correction values $\Delta_{91}$, $\Delta_{92}$ and $\Delta_{93}$ corresponding to this head ID. Instead of equations (4a) to (5c), a value that is twice the value of the right-side term of the equations can be used as the relative correction value.

The second embodiment described above is characterized in that a relative correction value can be independently set for each actuator chip. This makes it possible to correct the relative positional deviation from the row of reference nozzles on an actuator chip by chip basis, enabling the positional deviation during bi-directional printing to be further decreased. Also, in the type of printer in which one actuator chip is used to drive three rows of nozzles, a relative correction value can be set independently for each three rows of nozzles.

From the viewpoint of improving the image quality of halftone regions, it is preferable to select light cyan dots and light magenta dots as target dots for positional deviation adjustment to reduce the positional deviation of those dots. However, when color printing is performed using M types of ink (where M is an integer of two or more), dots of specific inks having a relatively low density (which is to say, particular inks other than black) among the M types of dots can be selected as the target dots and the working principle of the first and second embodiments can be applied to reduce the positional deviation of those target dots.

E. Third Embodiment (Correction of Positional Deviation Between Dots Using Absolute Correction Values)

(1) Overall Process Flow

Figure 23:
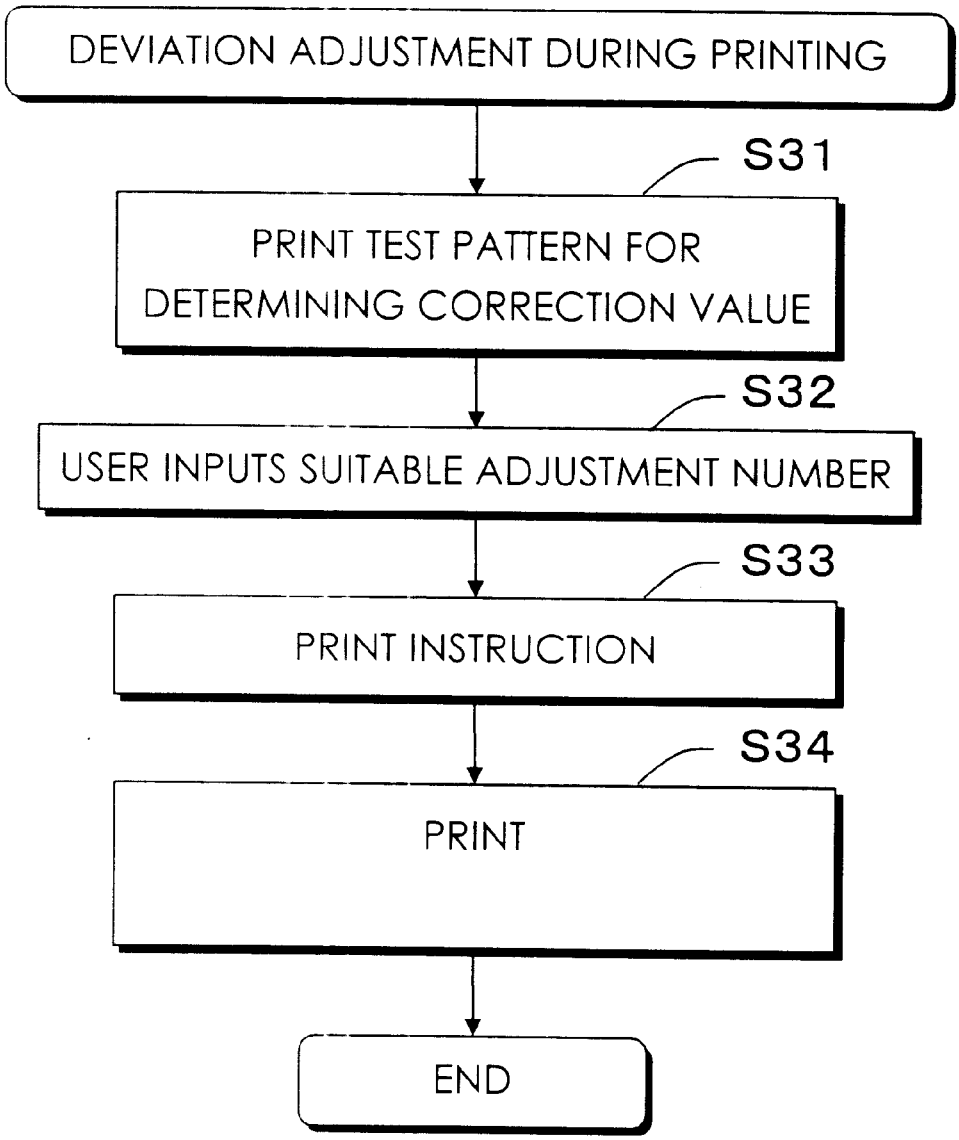
FIG. 23 is a flow chart of the deviation adjustment procedure.

FIG. 23 is a flow chart of the deviation adjustment procedure in the third embodiment. In the case of the first and second embodiments a reference correction value is determined with respect to black (K), and a relative correction value is determined for each of the other colors using black (K) as the reference. In the case of the third embodiment an absolute correction value is determined for each of selected colors, as is the case with the black ink in the first embodiment, and in principle all printing position adjustment is done by the user. That is, in the third embodiment the adjustment value is determined differently than in the first embodiment. Thus, the adjustment number storage area and correction value table composition, as well as the processing by the positional deviation correction section are all different compared to the first embodiment. Other aspects are the same as in the first embodiment.

Figure 24:
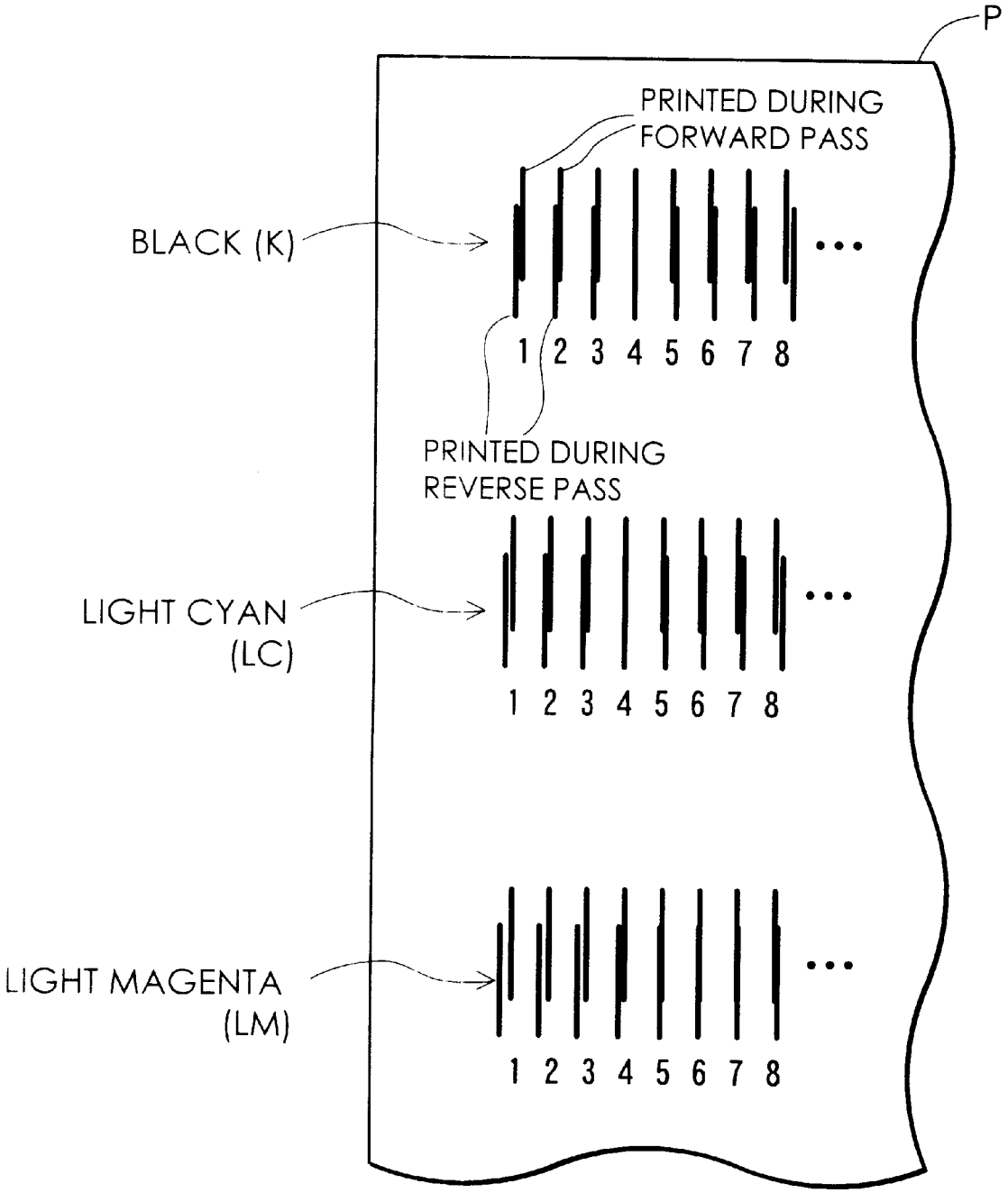
FIG. 24 shows a test pattern printed out for determining correction values in the third embodiment.

FIG. 24 shows a test pattern printed out for determining correction values in the third embodiment. In step S31 (FIG. 23), the test pattern is printed by the printer 20 to determine the correction values. A test pattern corresponding to the reference correction value test pattern of the first embodiment shown in FIG. 16 is individually printed for the black nozzle row K, the light cyan nozzle row LC and the light magenta nozzle row LM. As shown in FIG. 24, the result is test patterns printed during forward and reverse passes relating to black (K), light cyan (LC) and light magenta (LM).

In step S32, the user inspects the test pattern for each color and inputs the deviation adjustment number assigned to the pairs of lines having the least deviation into the computer 88, via displayed screen of the printer driver interface(not shown). As a result, a pair of adjustment numbers representing the correction values for the light cyan nozzle row LC and the light magenta nozzle row LM and an adjustment number representing the correction value for the black nozzle row K are stored in the P-ROM 43 in the printer 20. These deviation adjustment numbers can instead be input via the control panel 32.

The correction values for the light cyan nozzle row LC and the light magenta nozzle row LM are used as the basis for determining a single adjustment value for the overall correction of all the color nozzle rows. In contrast, the correction value relating to the black nozzle row K is used only for the black nozzle row K. As such, in the following correction values relating to the light cyan nozzle row LC and the light magenta nozzle row LM are handled together as chromatic color correction values, and the correction value for the black nozzle row K is referred to as an achromatic color correction value. The relation of chromatic and achromatic color correction values are not that of relative and reference correction values, but chromatic and achromatic color correction values stand on their own as providing optimum correction for their respective nozzle row. The terms achromatic color correction value and chromatic color correction value as used here correspond to the terms first correction value and second correction value, respectively, in the claimed invention.

Figure 25:
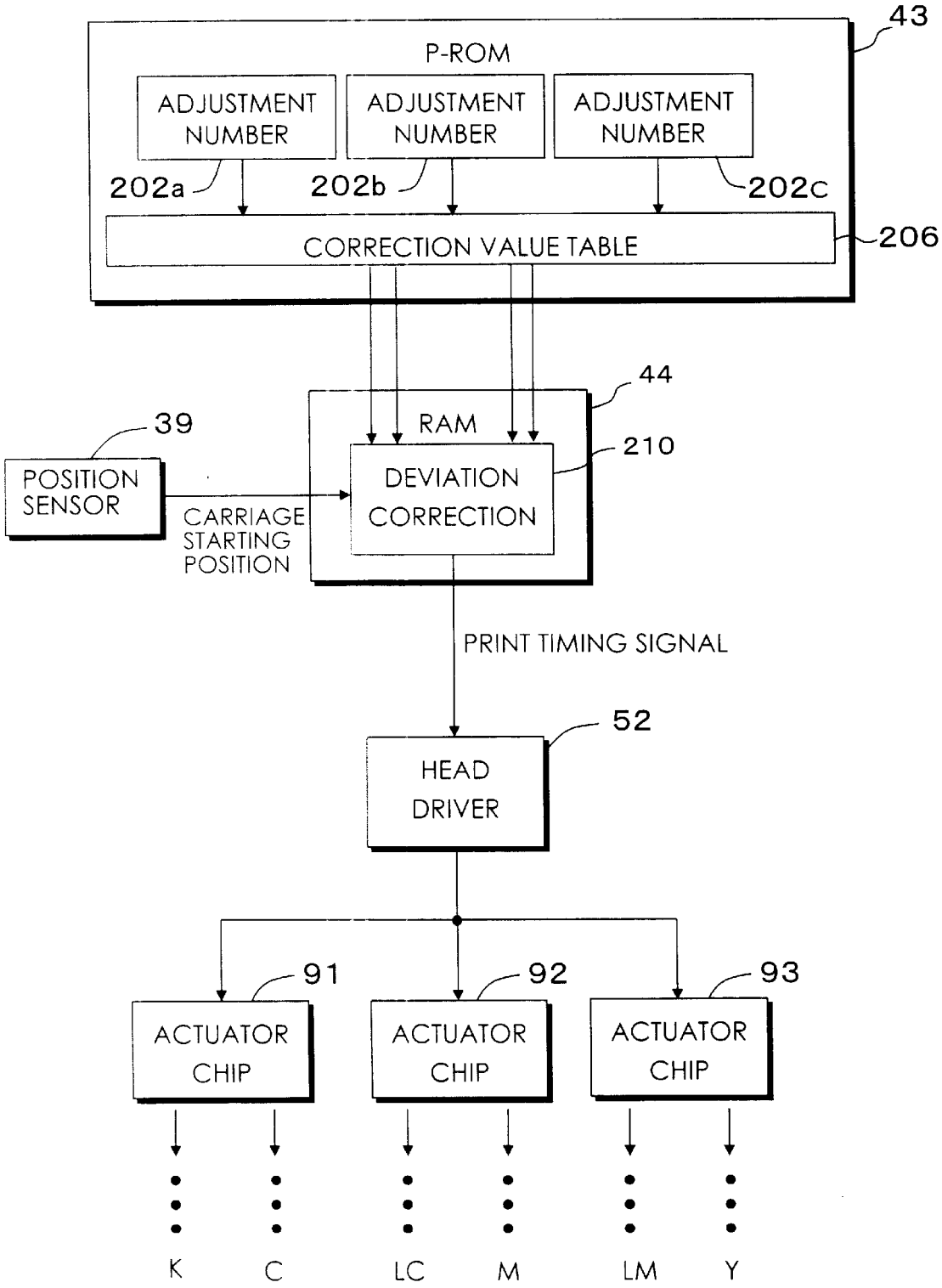
FIG. 25 is a block diagram of the main configuration involved in the correction of deviation during bi-directional printing in the case of the third embodiment.

Next, in step S33, the user issues the command to start the printing, and in step S34, bi-directional printing is carried out while using the correction values to correct deviation. FIG. 25 is a block diagram of the main configuration involved in the correction of deviation during bi-directional printing in the third embodiment. The P-ROM 43 in the printer 20 has adjustment number storage areas 202*a*–202*c* for black, light cyan and light magenta, and a correction value table 206. Stored in the storage areas 202*a*–202*c* are adjustment numbers representing the preferred reference correction values for black, light cyan and light magenta. The table 206 is used to store the relationships between the printing positional deviation amount (that is, the correction value) of the reverse-pass vertical lines on the test pattern and the deviation adjustment number.

The RAM 44 in printer 20 is used to store a computer program that functions as a positional deviation correction section (printing position adjuster) 210 for correcting positional deviation during bi-directional printing. The deviation correction section 210 supplies the head drive circuit 52 with a printing timing signal that corresponds to an adjustment value determined by the positional deviation correction section 210 based on the achromatic and chromatic color correction values. Other items are the same as in the first embodiment.

Figure 26:
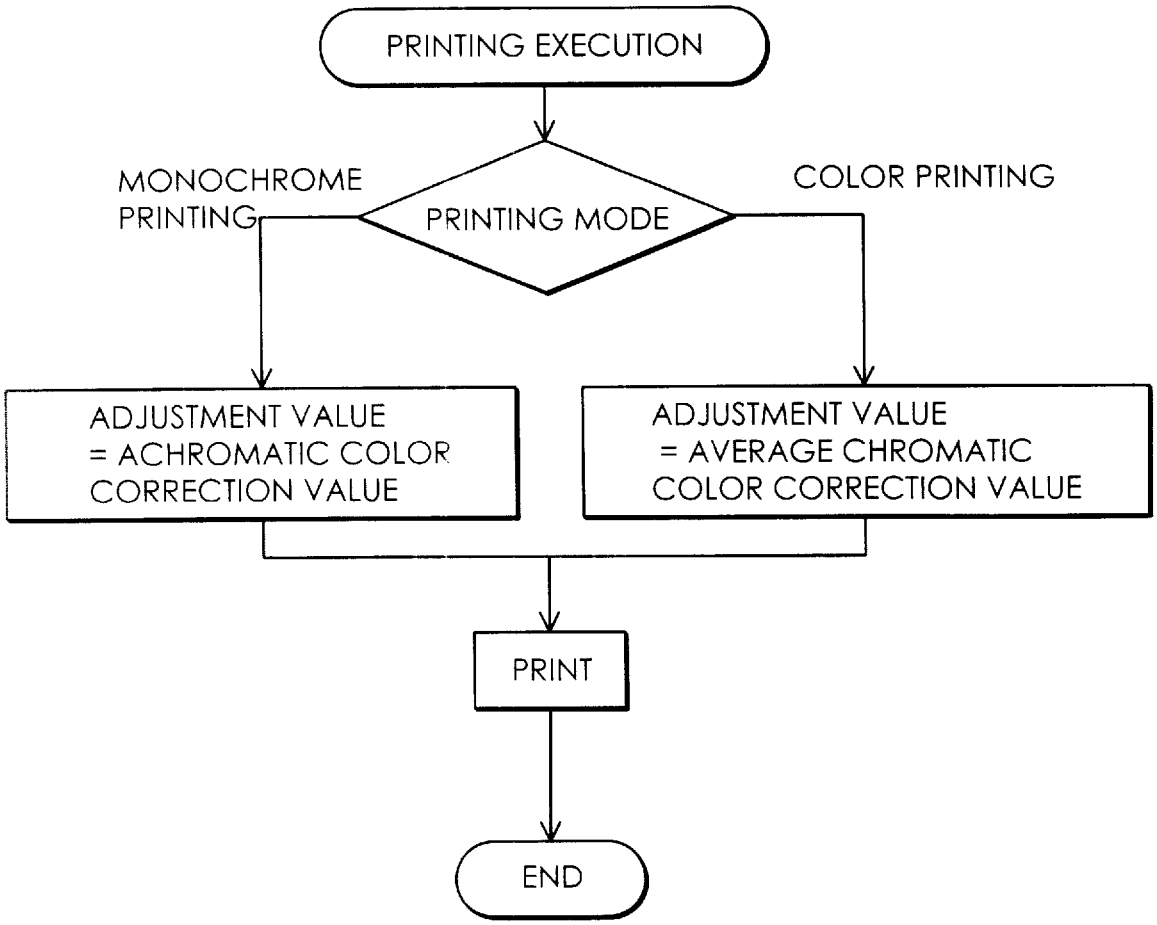
FIG. 26 is a flow chart of the process used to determine the adjustment values used to correct deviation during bi-directional printing.

FIG. 26 is a flow chart of the process used to determine the adjustment value used to correct deviation during bi-directional printing. When the deviation correction section 210 (FIG. 25) receives a notification of monochrome printing from the computer 88 (FIG. 1), it substitutes the achromatic color correction value for the adjustment value and sends a printing timing signal to the head drive circuit 52. When the computer 88 sends a notification of color printing, deviation correction section 210 substitutes the average value of the chromatic color correction values for light cyan and light magenta and sends a printing timing signal to the head drive circuit 52.

(2) Effect of Third Embodiment

In this embodiment each of the chromatic color correction values is determined on the basis of respective test patterns printed during forward and reverse main scanning passes. This makes it possible to set accurate correction values that reduce actual printing deviation.

During color printing the average value of the chromatic color correction values for light cyan and light magenta are used for correction, while during monochrome printing the achromatic color correction value is used for correction relating to the black nozzle row. This enables the optimum correction for each printing mode to be implemented.

In the third embodiment, also, the light cyan and light magenta nozzle groups are used as reference for determining the adjustment value during color printing. Light cyan and light magenta are the inks used most extensively in halftone regions of color images and the positional precision of dots printed in these colors has a major effect on the image quality. As such, using the light cyan and light magenta nozzle groups as the reference for determining the adjustment value during color printing, as in the third embodiment, enables halftone image quality to be enhanced.

(3) First Modification of the Third Embodiment

Figure 27:
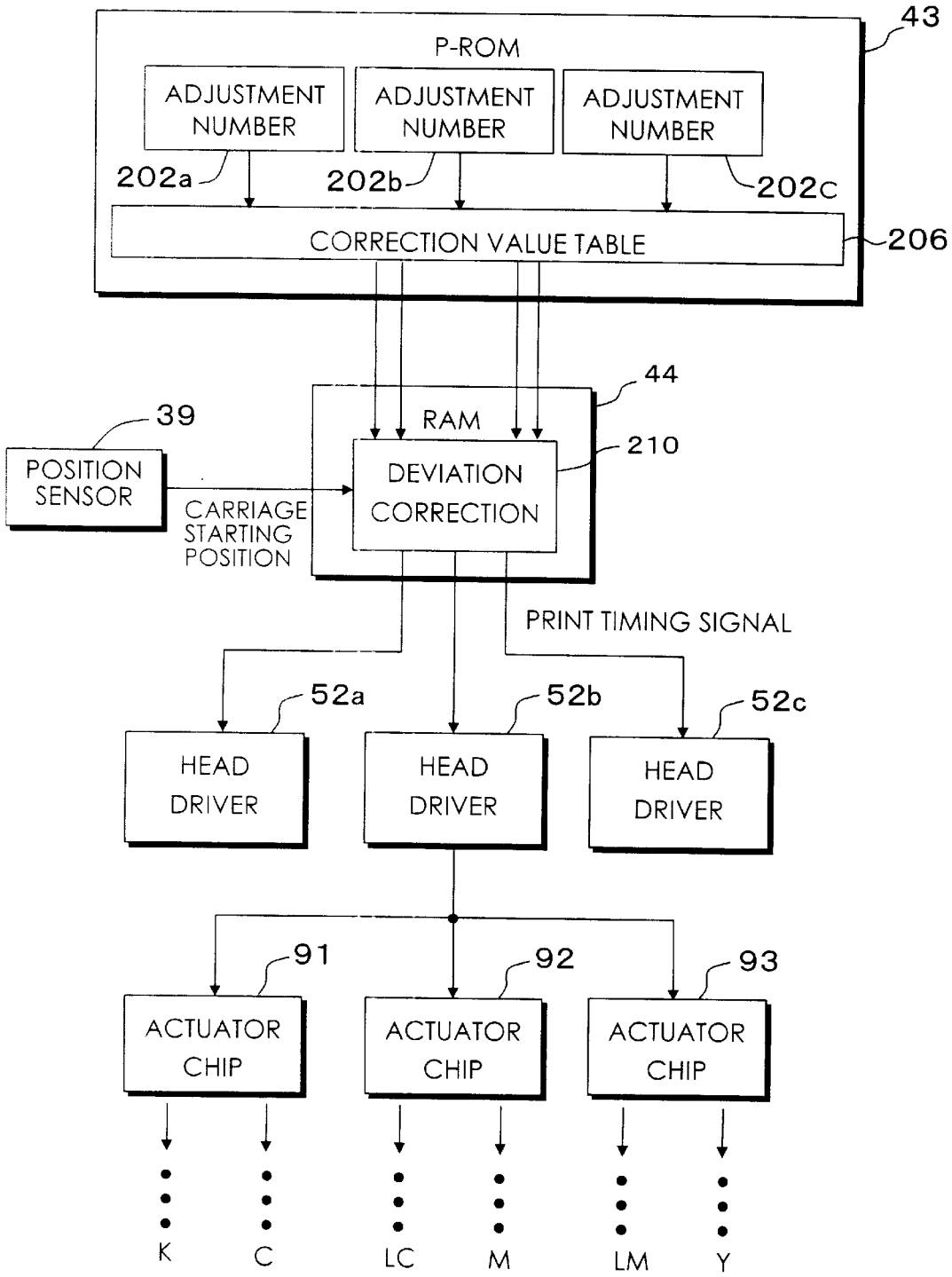
FIG. 27 is a block diagram of the main configuration involved in the correction of deviation during bi-directional printing in the case of a first modification of the third embodiment.

FIG. 27 is a block diagram of the main configuration involved in the correction of deviation during bi-directional printing in the case of a first modification of the third embodiment. The difference compared to the configuration of FIG. 25 is that each of the actuator chips 91, 92 and 93 is provided with its own head drive circuit 52*a*, 52*b* and 52*c*, allowing each actuator chip to be driven independently. Correction of positional deviation during bi-directional printing can therefore also be effected on an actuator chip by chip basis.

(4) Second Modification of the Third Embodiment

Figure 28:
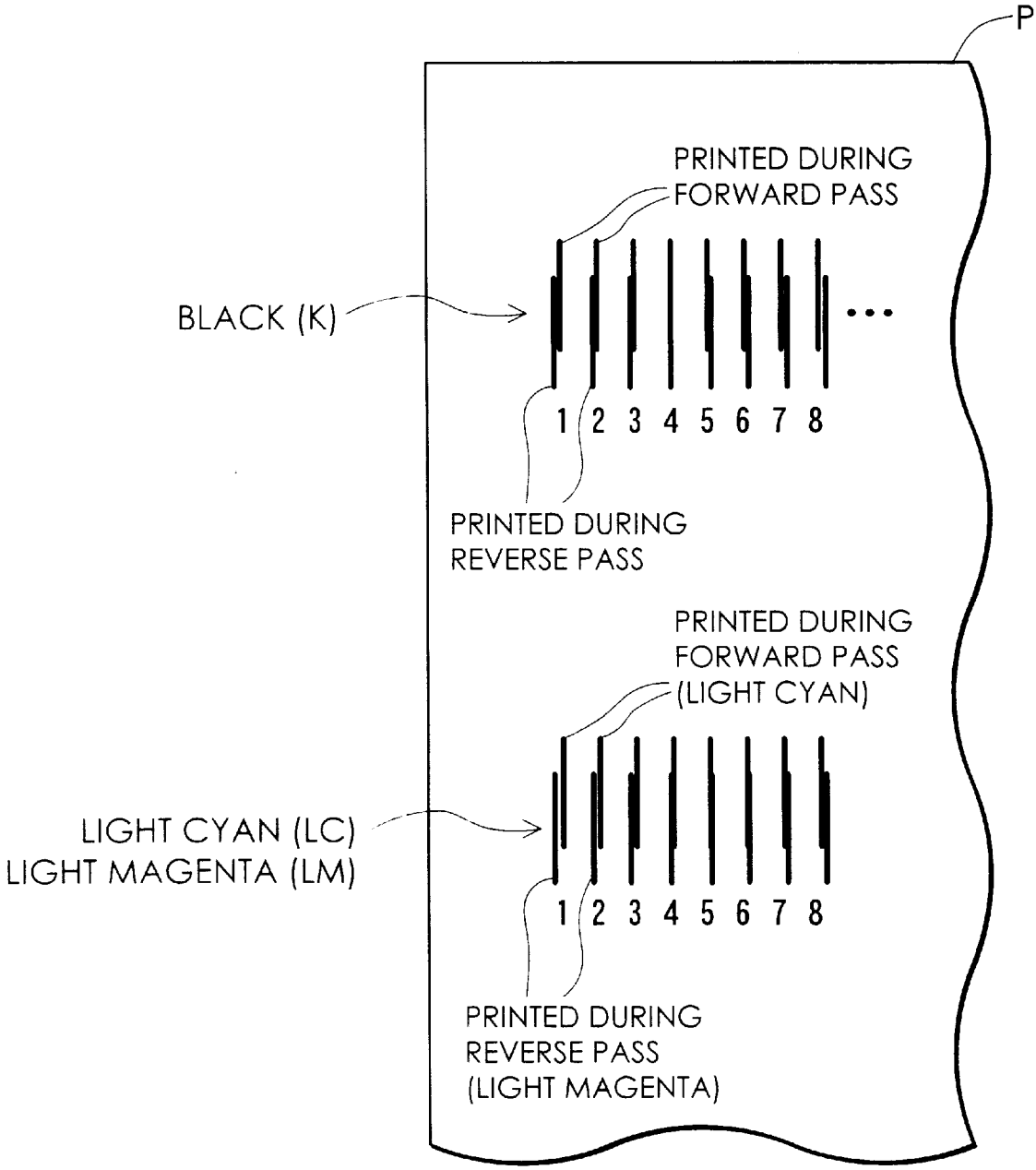
FIG. 28 shows a test pattern printed out for determining correction values in a second modification of the third embodiment.

FIG. 28 shows a test pattern printed out for determining correction values in a second modification of the third embodiment. In accordance with the third embodiment forward and reverse pass test patterns are printed out in light cyan and light magenta to obtain correction values for each color. However, instead a single test pattern may be printed in light cyan and light magenta and used to determine a correction value that is the average of the two correction values. As shown in FIG. 28, vertical lines are formed of light cyan ink during a forward pass and vertical lines of light magenta ink are formed during the reverse pass. The light magenta lines may instead be formed during the forward pass and the light cyan lines during the reverse pass. The degree of agreement of these lines can then be used as the basis for obtaining an adjustment value that is the average of the correction values. The adjustment value thus obtained is equivalent to the average of the optimum correction values for light cyan and light magenta that are determined using the two test patterns shown in FIG. 24.

The above second modification is not limited to light cyan and light magenta. A first sub-pattern may be printed during a forward pass using droplets of a first ink and a second sub-pattern may be printed during a reverse pass using droplets of a second ink. Then a correction value may be determined in accordance with correction information representing a preferred correction condition selected from a positional deviation check pattern that includes the first and the second sub-patterns. The correction value thus obtained will give an average value of the two optimum correction values for the first and second inks.

(5) Third Modification of the Third Embodiment

In accordance with the third embodiment a test pattern is printed to determine an absolute correction value for each of three colors, and these values are used as a basis for determining a correction value to use during color printing. Therefore whenever a user feels it is necessary he or she may print out a test pattern for the colors concerned and reset the first correction value for monochrome printing and the second correction values for color printing. However, some users may find this troublesome. Accordingly, it is preferable that the printer changes the correction values for the other colors according to changes for black. Users may re-determine only the correction value for black based on a test pattern printed in black, as in the first embodiment.

Figure 29:
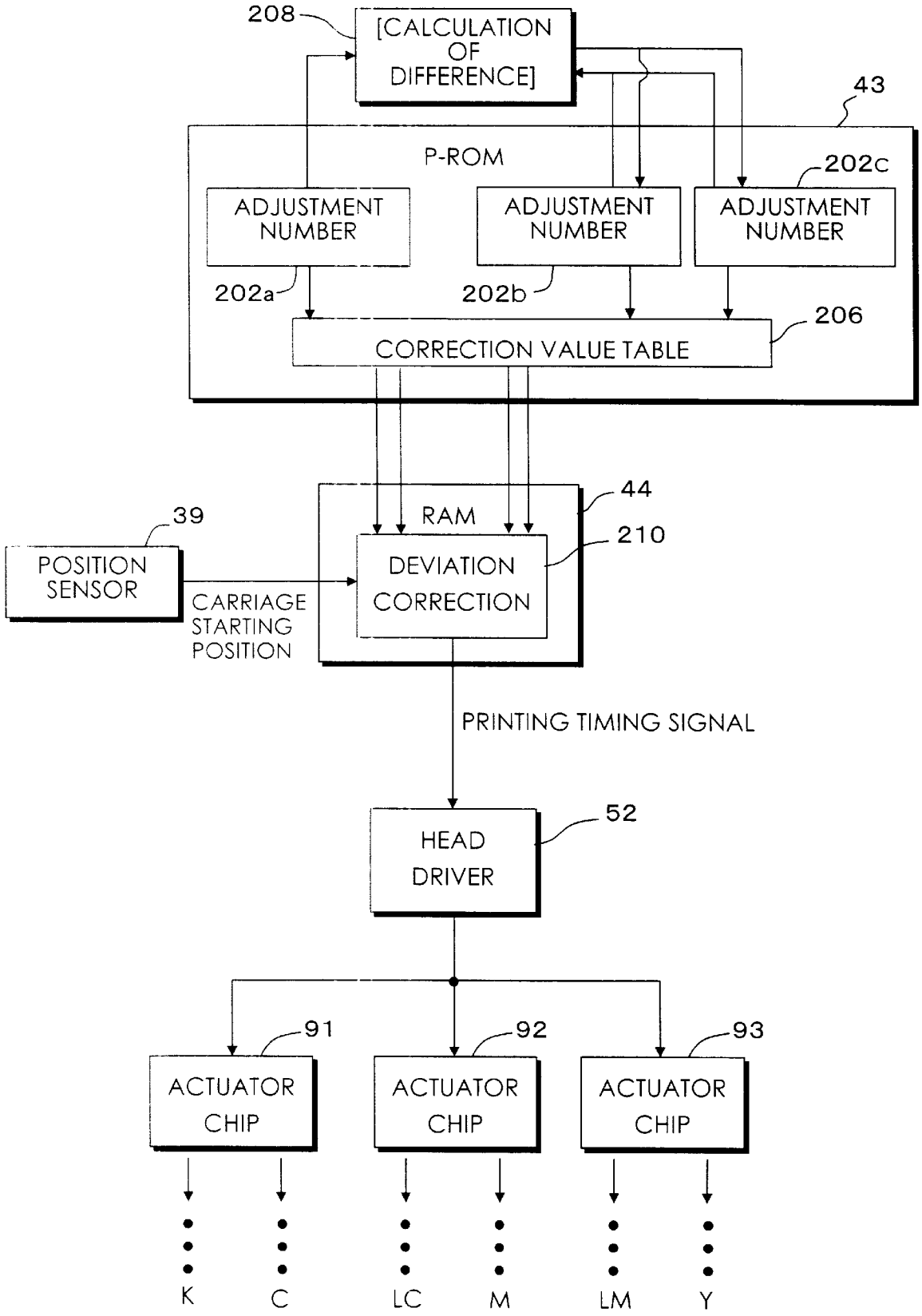
FIG. 29 is a block diagram of the main configuration involved in the correction of deviation during bi-directional printing in the case of the third modification of the third embodiment.

FIG. 29 is a block diagram of the main configuration involved in the correction of deviation during bi-directional printing in the case of the third modification of the third embodiment. The difference compared to the configuration of FIG. 25 is the provision of the adjustment number modification section 208 that when the adjustment number in the storage area 202*a* changes also changes the adjustment numbers in the storage areas 202*b* and 202*c* accordingly. The section 208 corresponds to the CPU 41 and RAM 44 shown in FIG. 2.

When the user prints out a test pattern to reset an adjustment number for black and uses the computer 88 or the control panel 32 to input the new black adjustment number and to provide input to the effect that test patterns for other colors are not to be printed, the adjustment number modification section 208 performs the following process. The adjustment numbers for each color prior to any change are stored in the section 208 beforehand. When the new adjustment number for black is passed to the section 208 from the adjustment number storage area 202*a*, the section 208 calculates the difference between the old and new numbers. A smaller number results in a minus differential, and the difference is added to the adjustment numbers for the other colors and new adjustment numbers computed for the other colors. The new adjustment numbers are then stored in the respective areas 202*b* and 202*c*. The adjustment numbers prior to change are stored in the RAM 44. The CPU41 calculates the difference resulting from the change and computes the new adjustment numbers for the other colors.

With this arrangement, the user only has to print out a test pattern for black to obtain new adjustment numbers for the other colors corresponding to the change made with respect to black. Thus, the user can print patterns for determining the optimum adjustment number for each color, or can print out a test pattern just for black and have the section 208 modify the adjustment numbers for the other colors, simplifying the adjustment procedure.

6) Others

Thus, in accordance with the third embodiment, during color printing correction is performed using the average of the chromatic color correction values for the light cyan nozzle row LC and the light magenta nozzle row LM. However, the nozzle rows concerned are not limited to this combi-nation. For example, when black nozzles are used during color printing correction may be performed using the average of the chromatic color correction values for LC and LM and achromatic color correction value for black nozzle row K. Also, in addition to the above nozzle rows, the application can also include the yellow nozzle row Y, dark cyan nozzle row C and dark magenta nozzle row M.

Moreover, as shown in the print head configuration of FIG. 20, In this example, the print head is provided with three rows of black (K) nozzles K1 to K3, and one row each of cyan (C), magenta (M) and yellow (Y) nozzles. In this case correction can be applied during color printing using the average of the chromatic color correction values for the cyan (C) and magenta (M) nozzle rows. And, when the black nozzles are used during color printing, correction may be performed using the average of the chromatic color correction values for C and M and achromatic color correction value for K, the same as described above. That is, it does not matter as long as a correction value is determined that reduces printing positional deviation of the prescribed target ink droplets during forward and reverse main scanning passes.

A weighted average correction value can be used instead of the simple average described above. Specifically, as the correction value, there may be used a weighted average of the chromatic ink colors yellow, light cyan, light magenta, dark cyan and dark magenta, and the achromatic black ink, that takes into consideration factors such as frequency of use, distance from, the center of the nozzle row, the prominence of printing positional deviation and the like. Likewise, a geometrical mean may be used. It does not matter how the first and chromatic color correction values are used, as long as at least chromatic color correction values are used as a basis for correcting deviation during forward and reverse main scanning passes.

Instead of vertical lines, test patterns may be comprised of patterns of dots spaced apart in straight lines, or other patterns. That is, any positional deviation test pattern may be used that enables correction information showing a preferred correction state to be selected and correction values determined. A test pattern of dots spaced in straight lines could be formed even in respect of nozzles that cannot form dots continuously in the secondary scanning direction by using main scanning to form the pattern in one pass.

Also, while in the third embodiment nozzles emitting ink of the same color were described as being arranged in a row, the nozzle configuration is not limited thereto but may be any arrangement wherein nozzles emitting the same color ink are grouped together.

Similarly, the test pattern is not limited to forming equally spaced vertical lines during a forward pass and during the reverse pass forming vertical lines that are each more slightly displaced from the forward pass lines. A test pattern for determining correction values for monochrome printing may be formed as an achromatic color deviation test pattern that includes a forward-pass achromatic color sub-pattern formed during forward main scanning passes and a reverse-pass achromatic color sub-pattern formed during reverse main scanning passes. Similarly, for color printing, a chromatic color deviation test pattern may be used that includes a forward-pass chromatic color sub-pattern formed during forward main scanning passes and a reverse-pass chromatic color sub-pattern formed during reverse main scanning passes.

F. Other Modifications

The invention is not limited to the embodiments and modes described above. Instead, numerous modifications and modifications that fall within the scope of the present invention are possible, such as the following modifications.

F1. Modification 1

With respect to using reference and relative correction values to correct positional deviation during bi-directional, as in the first and second embodiments, when the printer used is able to move the carriage at a plurality of main scanning velocities, relative correction values for the nozzle rows should be set for each such main scanning speed. As in the third embodiment, with respect also to when an absolute correction value is set for each nozzle row, when the printer used is capable of moving the carriage at a plurality of main scanning velocities (speeds), the correction values may be set for each main scanning speed. As can be understood from the explanation made with reference to FIG. 9, changing the main scanning velocity Vs also changes the degree of relative positional deviation between the rows of nozzles. As such, setting a relative correction value for each main scanning speed makes it possible to achieve a further decrease in positional deviation during bi-directional printing.

F2. Modification 2

With respect to a multilevel printer which is capable of printing dots of the same color in different sizes, as in the first and second embodiments, it is preferable to set a relative correction value for each dot size. As in the third embodiment, with respect also to when an absolute correction value is set for each nozzle row, when the printer used is capable of printing dots of the same color in different sizes, the correction values may be set for each dot size. Setting a relative correction value for each dot size makes it possible to achieve a further decrease in positional deviation during bi-directional printing. Sometimes a multilevel printer is only able to form dots of the same size in one main scanning pass using one row of nozzles. When this is the case, a dot size is selected for each main scanning pass, so with respect also to the relative correction value used to correct the positional deviation, for each main scanning pass a suitable value is selected in accordance with the dot size concerned.

The printing operations each produces dots of different size may be thought to be different printing modes that emit ink at mutually different velocities. The Modification 2 therefore would mean setting relative correction values with respect to each of the plural printing modes in which dots are formed using ink emitted at different velocities.

F3. Modification 3

In the second embodiment relative correction values are set for each of the actuator chips used to drive the two rows of nozzles. It is also preferable to set relative correction values independently for each nozzle row other than the reference nozzle row. Similarly, with respect to the third embodiment, it is preferable to set the chromatic color correction values independently for each of the nozzle rows of the chromatic-color nozzle groups. Doing this makes it possible to reduce positional deviation even further. Relative correction values may also be set independently to the sets of the single-chromatic-color nozzle groups that emit ink of the same color. When, for example, there are provided two sets of nozzle rows that emit a specific ink, the same relative correction value may be applied to the two sets of nozzles.

F4. Modification 4

In the first and second embodiments the row of black ink nozzles is selected as the reference row of nozzles when determining the reference and relative correction values. However, it is also possible to select a different row of nozzles as the reference. However, selecting a low density color ink such as light cyan or light magenta makes it harder for a user to read the test pattern used during determination of a reference correction value. Therefore, it is preferable to select as the reference a row of nozzles used to emit a relatively high density ink such as black, dark cyan, and dark magenta.

F5. Modification 5

In the first and second embodiments positional deviation is corrected by adjusting the position (or timing) at which dots are printed. However, positional deviation may be corrected by other methods, for example by delaying the drive signals to the actuator chips or by adjusting the frequency of the drive signals.

F6. Modification 6

In each of the foregoing embodiments positional deviation is corrected by adjusting the positioning (or timing) of dots printed during a reverse pass. However, positional deviation may be corrected by adjusting the positioning of dots printed during a forward pass, or by adjusting the positioning of dots printed during both forward and reverse passes. Thus, all that matters is that the positions at which dots are printed be adjusted during at least one selected from a forward pass and a reverse pass.

F7. Modification 7

The above embodiments were each described with respect to an inkjet printer. However, the present invention is not limited thereto and may be applied to any of various printing apparatuses that print using a print head. Similarly, the present invention is not limited to an apparatus or method for emitting ink droplets, but can also be applied to apparatuses and methods used to print dots by other means.

F8. Modification 8

While the configurations of the above embodiments have been implemented in terms of hardware, the configurations may be partially replaced by software. Conversely, software-based configurations may be partially replaced by hardware. For example, some of the functions of the head drive circuit 52 shown in FIG. 12 may be implemented in software.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A bi-directional printing apparatus that bi-directionally prints images on a print medium during forward and reverse main scanning passes, the printing apparatus comprising:

a print head having a group of nozzles for printing dots on the print medium by emitting ink droplets;

a main scanning drive mechanism that effects bi-directional main scanning by moving at least one selected from the print medium and the print head;

a sub-scanning drive mechanism that effects sub-scanning by moving at least one selected from the print medium and the print head;

a head driver that supplies drive signals to the print head to effect printing on the print medium; and a controller for controlling bi-directional printing;

wherein the print head includes:

an achromatic-color nozzle group that emits ink droplets of an achromatic color; and chromatic-color nozzle groups comprising a plurality of single chromatic-color nozzle groups each emitting ink droplets of one of a plurality of chromatic colors;

where in the controller includes a printing position adjuster that uses an adjustment value to reduce printing positional deviation arising between forward and reverse main scanning passes;

the printing position adjuster having a monochrome printing mode in which a first correction value is used as the adjustment value, and a color printing mode in which a second correction value that is determined separately from the first correction value is used as the adjustment value, the monochrome printing mode using only achromatic color ink, the color printing mode using the achromatic color ink and chromatic color inks.

2. A bi-directional printing apparatus according to claim 1, wherein the second correction value is set to reduce printing positional deviation of ink droplets of a target color selected from among ink droplets emitted by the plurality of single-chromatic-color nozzle groups.

3. A bi-directional printing apparatus according to claim 2, wherein the plurality of single-chromatic-color nozzle groups includes a cyan nozzle group that emits cyan ink droplets and a magenta nozzle group that emits magenta ink droplets, and the second correction value is set to reduce printing positional deviation of the cyan ink droplets and the magenta ink droplets arising during forward and reverse main scanning passes.

4. A bi-directional printing apparatus according to claim 2, wherein the plurality of single-chromatic-color nozzle groups includes a light cyan nozzle group that emits light cyan ink droplets and a light magenta nozzle group that emits light magenta ink droplets, and the second correction value is set to reduce printing positional deviation of the light cyan ink droplets and the light magenta ink droplets arising during forward and reverse main scanning passes.

5. A bi-directional printing apparatus according to claim 1, wherein the first correction value is determined according to correction information indicative of a preferred correction state that is selected from among a first test pattern of positional deviation printed using the achromatic-color nozzle group, and the second correction value is set according to correction information indicative of a preferred correction state that is selected from among a second test pattern of positional deviation printed using at least one of the single-chromatic-color nozzle groups.

6. A bi-directional printing apparatus according to claim 5, wherein the plurality of single-chromatic-color nozzle groups includes a cyan nozzle group that emits cyan ink droplets and a magenta nozzle group that emits magenta ink droplets, and the second positional deviation test pattern includes a second forward pass sub-pattern printed during a main scanning forward pass using either one of the cyan nozzle group and the magenta nozzle group, and a second reverse pass sub-pattern printed during a main scanning reverse pass using the other of the cyan nozzle group and the magenta nozzle group.

7. A bi-directional printing apparatus according to claim 1, wherein the bi-directional printing apparatus is capable of performing main scanning at a plurality of main scanning velocities and the second correction value is set independently to the plurality of main scanning velocities.

8. A bi-directional printing apparatus according to claim 1, wherein the bi-directional printing apparatus is capable of performing main scanning at a plurality of main scanning velocities and the first correction value is set independently to the plurality of main scanning velocities.

9. A bi-directional printing apparatus according to claim 1, wherein the bi-directional printing apparatus is capable of emitting ink in a plurality of dot emission modes of mutually different ink emission velocities, and the second correction value is set independently to each of the plurality of dot emission modes.

10. A bi-directional printing apparatus according to claim 1, wherein the bi-directional printing apparatus is capable of emitting ink in a plurality of dot emission modes of mutually different ink emission velocities, and the first correction value is set independently to each of the plurality of dot emission modes.

11. A bi-directional printing apparatus according to claim 1, wherein the second correction value is applied in common for the chromatic-color nozzle groups.

12. A bi-directional printing apparatus according to claim 11, wherein in the color printing mode the second correction value is applied in common for the chromatic-color nozzle groups and the achromatic-color nozzle group.

13. A bi-directional printing apparatus according to claim 1, wherein the second correction value is set independently to each of the single-chromatic-color nozzle groups.

14. A bi-directional printing apparatus according to claim 1, wherein the second correction value is set independently to each of the sets of the single-chromatic-color nozzle groups that emit ink of a same color.

15. A bi-directional printing apparatus according to claim 1, further including a non-volatile memory containing the first correction value and the second correction value.

16. A bi-directional printing apparatus according to claim 15, wherein the non-volatile memory is attached to the print head, so as to be detachably attached to the printing apparatus with the print head.

17. A bi-directional printing method for bi-directionally printing images on a print medium during forward and reverse main scanning passes using a printing apparatus having a print head that includes nozzle groups for printing-dots on the print medium by emitting Ink droplets, the method comprising the steps of:

(a) with a first correction value, correcting printing positional deviation of the ink droplets arising between forward and reverse main scanning passes in a monochrome printing mode in which only ink droplets of an achromatic color are used, and (b) with a second correction value, correcting printing positional deviation of the ink droplets arising between forward and reverse main scanning passes in a color printing mode in which ink droplets of the achromatic color and chromatic colors are used.

18. A bi-directional printing method according to claim 17, further comprising the step of:

setting the second correction value to reduce printing positional deviation of a light cyan ink droplets and a light magenta ink droplets arising during forward and reverse main scanning passes.

19. A bi-directional printing method according to claim 17, further comprising the steps of:

setting the first correction value according to correction information indicative of a preferred correction state that is selected from among a first test pattern of positional deviation printed using achromatic color ink; and setting the second correction value according to correction information indicative of a preferred correction state that is selected from among a second test pattern of positional deviation printed using at least chromatic color inks.

20. A computer program product storing a computer program for causing a computer to print images bi-directionally on a print medium during forward and reverse main scanning passes, the computer including a printing apparatus having a print head that includes nozzle groups for printing dots on the print medium by emitting ink droplets, the computer program product comprising:

a computer readable medium; and a computer program stored on the computer readable medium;

wherein the computer program causes the computer to correct printing positional deviation of the ink droplets arising between forward and reverse main scanning passes using a first correction value in a monochrome printing mode in which only ink droplets of an achromatic color are used, and to correct printing positional deviation of the ink droplets arising between forward and reverse main scanning passes using a second correction value in a color printing mode in which ink droplets of the achromatic color and chromatic colors are used.

* * * * *